US009782980B2

(12) United States Patent
Yoshida

(10) Patent No.: US 9,782,980 B2
(45) Date of Patent: Oct. 10, 2017

(54) OPTICAL SCANNING DEVICE AND IMAGE FORMING APPARATUS INCLUDING THE SAME

(71) Applicant: KYOCERA Document Solutions Inc., Osaka-shi, Osaka (JP)

(72) Inventor: Shingo Yoshida, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/244,274

(22) Filed: Aug. 23, 2016

(65) Prior Publication Data

US 2017/0057246 A1 Mar. 2, 2017

(30) Foreign Application Priority Data

Aug. 28, 2015 (JP) ..... 2015-169183

(51) Int. Cl.

| | |
|---|---|
| ***B41J 2/44*** | (2006.01) |
| ***G03G 15/04*** | (2006.01) |
| ***G03G 15/043*** | (2006.01) |
| *G03G 15/08* | (2006.01) |

(52) U.S. Cl.

CPC ..... *B41J 2/44* (2013.01); *G03G 15/0435* (2013.01); *G03G 15/04036* (2013.01); *G03G 15/0879* (2013.01); *G03G 2215/0132* (2013.01)

(58) Field of Classification Search

CPC ..... B41J 2/44; G03G 2215/0132; G02B 5/09; G02B 26/10; G02B 26/125; H04N 1/024; H04N 1/02409

USPC ..... 347/243

See application file for complete search history.

(56) References Cited

U.S. PATENT DOCUMENTS

| | | | | |
|---|---|---|---|---|
| 2002/0114050 | A1* | 8/2002 | Iizuka | G02B 26/123 359/204.1 |
| 2003/0214693 | A1* | 11/2003 | Hayashi | B41J 2/471 359/204.1 |
| 2006/0000990 | A1 | 1/2006 | Hayashi et al. | |
| 2008/0062493 | A1 | 3/2008 | Miyatake | |

FOREIGN PATENT DOCUMENTS

| | | |
|---|---|---|
| JP | 2004-117390 | 4/2004 |

* cited by examiner

*Primary Examiner* — Huan Tran
*Assistant Examiner* — Alexander D Shenderov
(74) *Attorney, Agent, or Firm* — Gerald E. Hespos; Michael J. Porco; Matthew T. Hespos

(57) ABSTRACT

An optical scanning device includes a light source, a deflector, and a plurality of scanning lenses. A scanning lens lying closest to the deflector has a positive refractive power and the incident surface of it allows the oblique angle θ of the light beam entering the incident surface to vary from a center to an end of the incident surface. The incident surface satisfies the following conditions, where Δθ is the amount of change and dθ is the rate of change in the oblique angle θ of the light beam in the main scanning direction, $d^2\theta$ is the rate of change in dθ, and $\Delta^2\theta$ is the amount of change in Δθ:

$d^2\theta<|0.036|$ when $\Delta^2\theta$ increases from the center to the end in the main scanning direction; and $d^2\theta<|0.061|$ when $\Delta^2\theta$ decreases from the center to the end in the main scanning direction.

6 Claims, 51 Drawing Sheets

OPTICAL SCANNING DEVICE AND IMAGE FORMING APPARATUS INCLUDING THE SAME

INCORPORATION BY REFERENCE

This application is based on Japanese Patent Application No. 2015-169183 filed with the Japan Patent Office on Aug. 28, 2015, the contents of which are hereby incorporated by reference.

BACKGROUND

The present disclosure relates to an optical scanning device including a configuration for passing a light beam emitted from a light source through scanning lenses to image the light beam onto a surface to be scanned, and an image forming apparatus including the optical scanning device.

A general optical scanning device used in an image forming apparatus such as a laser printer includes a light source configured to emit a laser beam, a deflector configured to deflect the laser beam to scan it over a surface to be scanned, and scanning lenses configured to image the deflected laser beam onto a circumferential surface (surface to be scanned) of a photoconductive drum. In the case of a color-type image forming apparatus, a plurality of light sources and photoconductive drums are respectively provided for each color. On the other hand, in some tandem-type color image forming apparatuses, an imaging optical system including the deflector and the scanning lenses is shared by a plurality of laser beams.

It is necessary to minimize a dimensional error of a mold for molding the scanning lens in order to allow the scanning lens to obtain predetermined optical properties. In particular, a scanning lens through which a plurality of laser beams pass (hereinafter, also referred to as "common scanning lens") has a high error sensitivity and, therefore, requires further reduction in the dimensional error of the mold.

SUMMARY

An optical scanning device according to an aspect of the present disclosure includes a light source configured to emit a light beam, a deflector, and a plurality of scanning lenses. The deflector deflects the light beam emitted from the light source to scan the light beam across a predetermined surface to be scanned. The plurality of scanning lenses are disposed between the deflector and the surface to be scanned, and image the light beam onto the surface to be scanned. Among the plurality of scanning lenses, at least a lens lying closest to the deflector includes an incident surface where the light beam enters and an exit surface where the light beam goes out, and has a positive refractive power in a main scanning direction. The incident surface allows the oblique angle θ of the light beam entering the incident surface with respect to the normal to the incident surface to vary from a center to an end of the incident surface in the main scanning direction. Further, the incident surface satisfies the following conditions, where Δθ is the amount of change and dθ is the rate of change in the oblique angle θ of the light beam in the main scanning direction, $d^2\theta$ is the rate of change in dθ, and $\Delta^2\theta$ is the amount of change in Δθ:

d2θ<|0.036| when Δ2θ increases from the center to the end in the main scanning direction; and d2θ<|0.061| when Δ2θ decreases from the center to the end in the main scanning direction.

Further, an image forming apparatus according to another aspect of the present disclosure includes a plurality of image carriers each configured to carry an electrostatic latent image, and the above-described optical scanning device configured to emit light beams to circumferential surfaces of the plurality of image carriers, each of the circumferential surfaces serving as the surface to be scanned.

These and other objects, features and advantages of the present disclosure will become more apparent upon reading the following detailed description along with the accompanying drawings.

DETAILED DESCRIPTION

Figure 1:
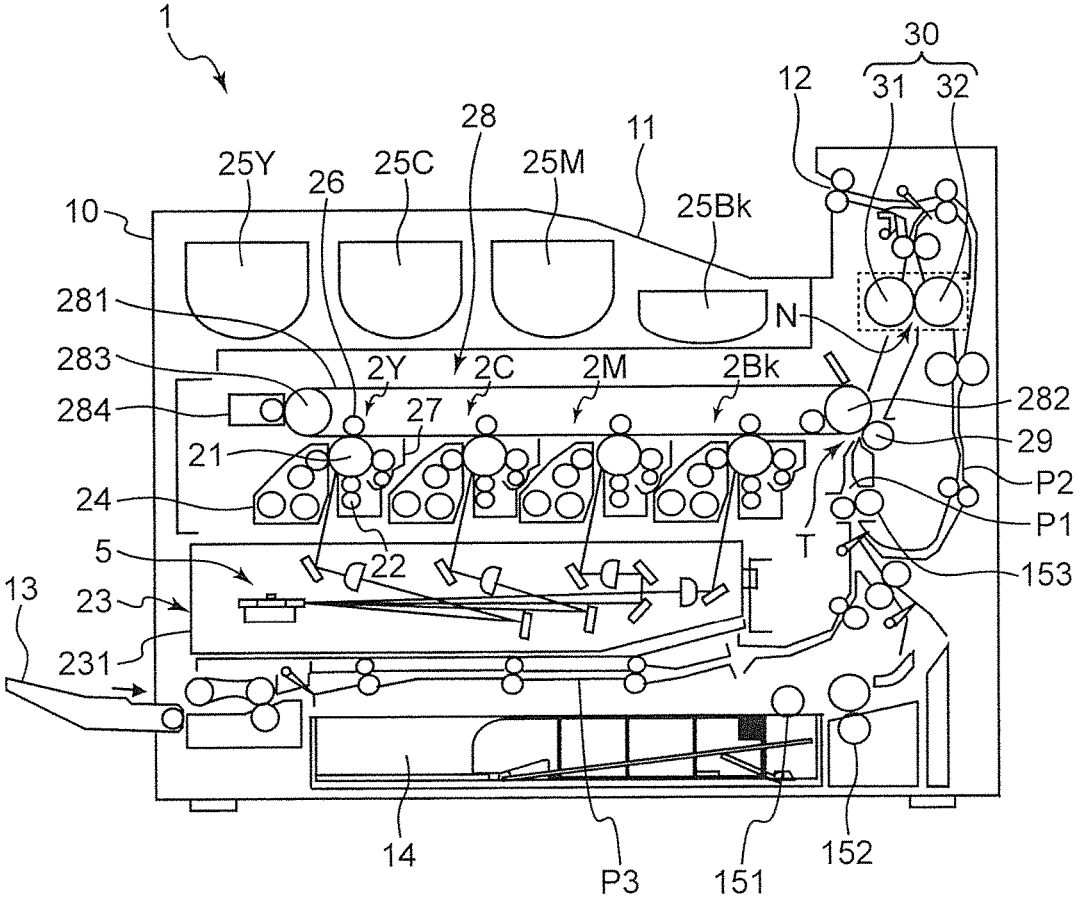
FIG. 1 is a sectional view showing a schematic configuration of an image forming apparatus according to an embodiment of the present disclosure.

Hereinafter, an embodiment of the present disclosure will be described in detail with reference to the accompanying drawings. FIG. 1 is a schematic sectional view showing an internal structure of an image forming apparatus 1 according to the embodiment of the present disclosure. The image forming apparatus 1 is configured as a color printer, and includes a main housing 10 having a generally parallelepiped shape.

The main housing 10 accommodates processing units for performing an image formation process on a sheet. In the present embodiment, the processing units include image forming units 2Y, 2C, 2M, and 2Bk, an optical scanning device 23, an intermediate transfer unit 28, and a fixing device 30. A sheet discharge tray 11 is disposed on a top surface of the main housing 10. A sheet discharge port 12 is open opposite the sheet discharge tray 11. A manual feed tray 13 is attached to a side wall of the main housing 10 in an openable/closable manner. A sheet feed cassette 14 for accommodating sheets to be subjected to the image formation process is detachably mounted in a lower portion of the main housing 10.

The image forming units 2Y, 2C, 2M, 2Bk form toner images of yellow, cyan, magenta, and black, respectively, in accordance with image information transmitted from an external device such as a computer, and are disposed in tandem at predetermined intervals in a horizontal direction. Each of the image forming units 2Y, 2C, 2M, and 2Bk includes a photoconductive drum 21 (image carrier) for carrying an electrostatic latent image and a toner image, a charger section 22 for charging a circumferential surface of the photoconductive drum 21, a developing section 24 for adhering developer to the electrostatic latent image to form the toner image, a toner container 25Y/25C/25M/25Bk for supplying toner of respective color to the developing section 24, a primary transfer roller 26 for primarily transferring the toner image formed on the photoconductive drum 21, and a cleaning section 27 for removing toner remaining on the circumferential surface of the photoconductive drum 21.

The optical scanning device 23 emits a light beam to the circumferential surface of the photoconductive drum 21 for each color, the circumferential surface serving as a surface to be scanned, to form an electrostatic latent image on the circumferential surface. The optical scanning device 23 of the present embodiment includes a plurality of light sources respectively prepared for each color, and an imaging optical system for imaging and scanning a light beam emitted from each of the light sources on the circumferential surface of the photoconductive drum 21 for each color. The imaging optical system is not in the form of independent optical systems respectively provided for each color, but in the form of an optical system that is partially shared. The optical scanning device 23 will be described in detail later.

The intermediate transfer unit 28 primarily transfers toner images formed on the photoconductive drums 21. The intermediate transfer unit 28 includes a transfer belt 281 which circulates while coming into contact with the circumferential surfaces of the photoconductive drums 21, and a driving roller 282 and a driven roller 283 around which the transfer belt 281 is wound. The transfer belt 281 is pushed against the circumferential surfaces of the photoconductive drums 21 by the primary transfer rollers 26. The toner images formed on the photoconductive drums 21 for the respective colors are primarily transferred to the same area on the transfer belt 281 in a superimposed manner. Consequently, a full color toner image is formed on the transfer belt 281.

A secondary transfer roller 29 is disposed opposite the driving roller 282 across the transfer belt 281, the secondary transfer roller 29 defining a secondary transfer nip T. The full color toner image formed on the transfer belt 281 is secondarily transferred onto a sheet at the secondary transfer nip T. Toner remaining on the surface of the transfer belt 281 without having been transferred onto the sheet is collected by a belt cleaning device 284 which is disposed opposite the driven roller 283.

The fixing device 30 includes a fixing roller 31 having an internal heat source, and a pressure roller 32 defining a fixing nip N in cooperation with the fixing roller 31. The fixing device 30 heats and presses the sheet to which the toner image has been transferred at the secondary transfer nip T, thereby performing a fixing process of welding toner onto the sheet at the fixing nip N. The sheet having been subjected to the fixing process is discharged through the sheet discharge port 12 to the sheet discharge tray 11.

A sheet conveyance passage for allowing a sheet to be conveyed therethrough is provided in the main housing 10. The sheet conveyance passage includes a main conveyance passage P1 vertically extending from a lower portion to an upper portion of the main housing 10 through the secondary transfer nip T and the fixing device 30. A downstream end of the main conveyance passage P1 connects with the sheet discharge port 12. A reverse conveyance passage P2 extends from the most downstream end to a vicinity of an upstream end of the main conveyance passage P1 for allowing a sheet to be conveyed therethrough in a reverse direction for double-sided printing. In addition, a manually-fed sheet conveyance passage P3 is disposed above the sheet feed cassette 14, the passage P3 extending from the manual feed tray 13 to the main conveyance passage P1.

The sheet feed cassette 14 includes a sheet storage portion for accommodating a stack of sheets. Near the upper right of the sheet feed cassette 14 are disposed a pickup roller 151 for picking up the sheets one by one from the top of the stack of sheets, and a pair of sheet feeding rollers 152 for feeding a picked-up sheet to the upstream end of the main conveyance passage P1. A sheet placed on the manual feed tray 13 is also fed to the upstream end of the main conveyance passage P1 through the manually-fed sheet conveyance passage P3. At an upstream side of the secondary transfer nip T in the main conveyance passage P1 is disposed a pair of register rollers 153 for feeding a sheet to the transfer nip at a predetermined timing.

In a single-sided printing (image formation) process, a sheet is fed from the sheet feed cassette 14 or the manual feed tray 13 to the main conveyance passage P1 to be subjected to the toner image transfer process at the secondary transfer nip T and, subsequently, to the fixing process for fixing the transferred toner thereon to the sheet at the fixing device 30. Thereafter, the sheet is discharged onto the sheet discharge tray through the sheet discharge port 12. On the other hand, in a double-sided printing process, after one side of a sheet is subjected to the transfer process and the fixing process, a portion of the sheet is discharged onto the sheet discharge tray 11 through the sheet discharge port 12, and then the sheet is returned to the vicinity of the upstream end of the main conveyance passage P1 by way of the reverse conveyance passage P2 in the manner of switchback. Thereafter, the other side of the sheet is subjected to the transfer process and the fixing process, and then the sheet is discharged onto the sheet discharge tray 11 through the sheet discharge port 12.

Figure 2:
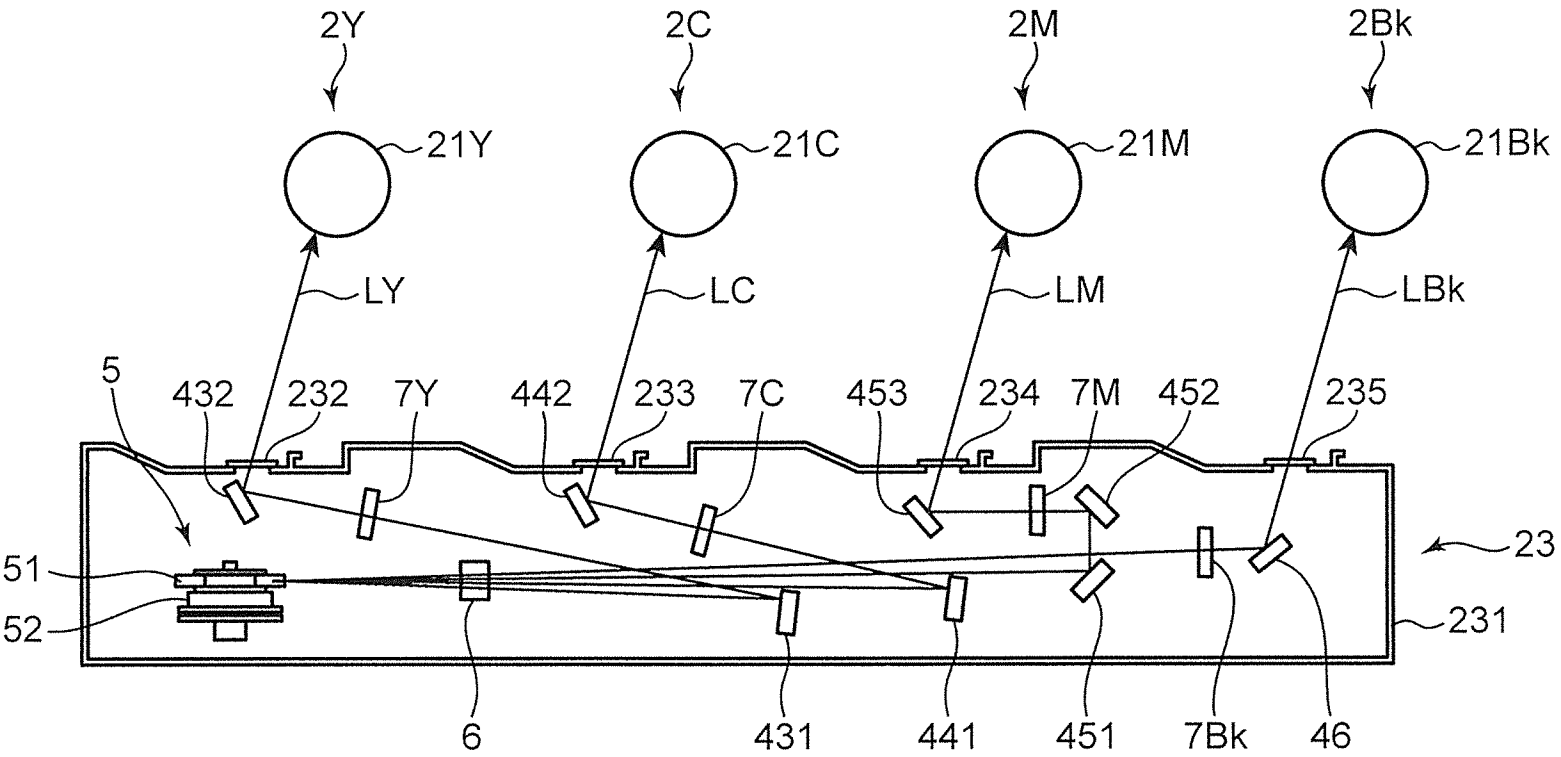
FIG. 2 is a sectional view showing an internal structure of an optical scanning device according to the embodiment of the present disclosure.
Figure 3:
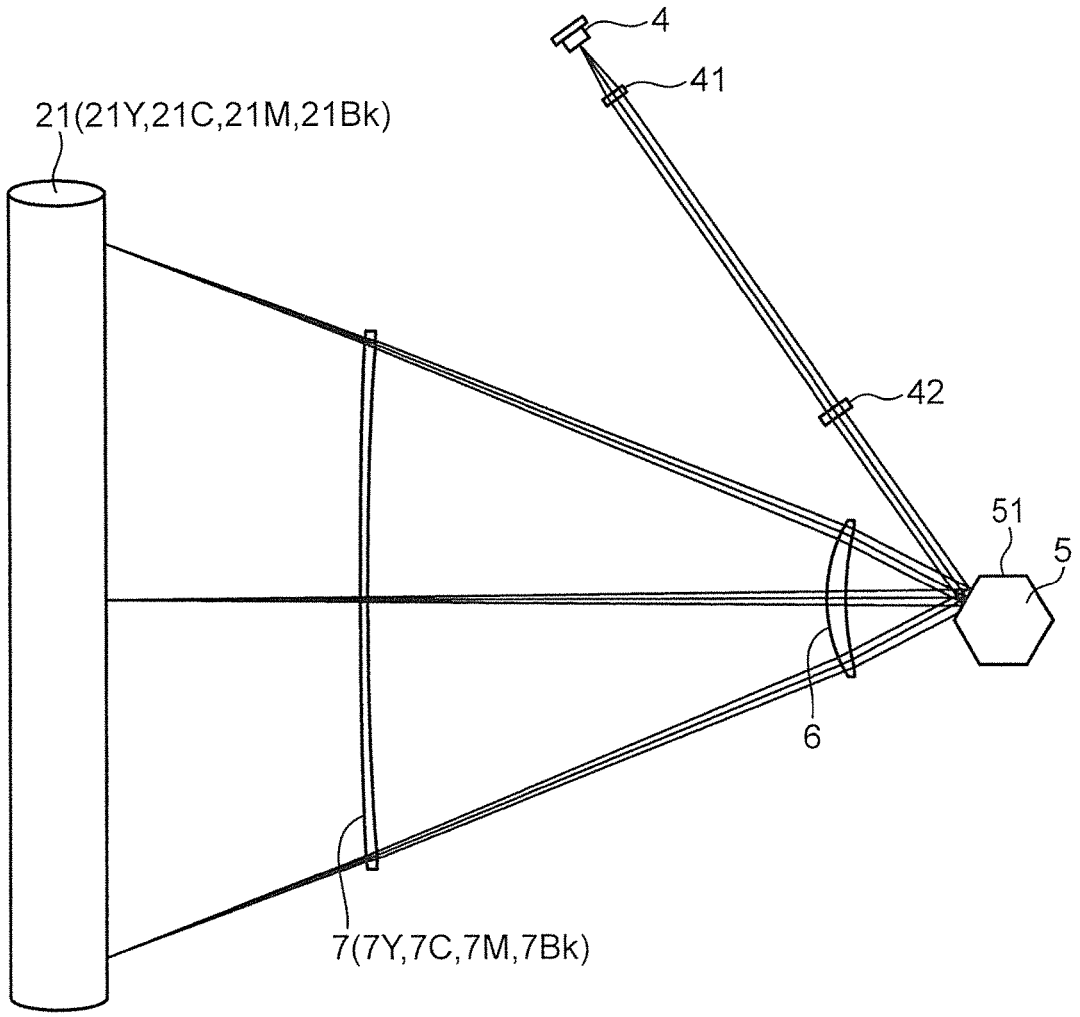
FIG. 3 is an optical path diagram showing a configuration of the optical scanning device in a main scanning cross section.

Now, the optical scanning device 23 will be described in detail. FIG. 2 is a sectional view showing an internal structure of the optical scanning device 23, and FIG. 3 is a plan view showing a configuration of the optical scanning device 23 in a main scanning cross section. The optical scanning device 23 includes a housing 231, laser units 4 (a light source/a plurality of light sources) disposed in the housing 231 and each dedicated for a specific color, a deflector 5, and an imaging optical system. The imaging optical system includes a collimator lens 41, a cylindrical lens 42, a first scanning lens 6 (a lens lying closest to the deflector/a common scanning lens), second scanning lenses 7 dedicated for respective colors (7Y, 7C, 7M, 7Bk), and a plurality of reflection mirrors.

The laser units 4 each include a semiconductor laser for emitting a laser beam of a single wavelength. FIG. 2 does not show any laser units 4 and FIG. 3 shows only one laser unit 4, but the four laser units 4 dedicated respectively for the colors of yellow, cyan, magenta and black are placed in the housing 231. The laser units 4 emit laser beams LY, LC, LM, Lbk in yellow, cyan, magenta, and black, respectively, as shown in FIG. 2. These laser beams LY, LC, LM, LBk are emitted to the circumferential surfaces (predetermined surfaces to be scanned that are respectively set for each light beam) of the photoconductive drums 21Y, 21C, 21M, 21Bk through window portions 232, 233, 234, 235, respectively, the window portions being formed in the housing 231 in such a manner as to respectively face the drums. The laser unit 4 may be in the form of a multi beam-type laser unit including modularized two to four semiconductive lasers, or a monolithic-type laser unit.

The deflector 5 deflects each of the laser beams emitted from the laser units 4 for the respective colors to scan it across a predetermined scanning range on the circumferential surface of the corresponding photoconductive drum 21Y/21C/21M/21Bk. The deflector 5 includes a polygon mirror 51 and a polygon motor 52 for rotating the polygon mirror 51. The polygon mirror 51 is one which has a deflecting surface extending along each side of a regular hexagon. A rotary shaft of the polygon motor 52 is connected to a central position of the polygon mirror 51. The polygon motor 52 is rotationally driven to thereby rotate the polygon mirror 51 around an axis of the rotary shaft to allow the polygon mirror 51 to deflect each of the laser beams LY, LC, LM, LBk emitted from the laser units 4 to scan it over the circumferential surface of the corresponding drum.

The first scanning lens 6 and the second scanning lenses 7 (plurality of scanning lenses) are disposed between the deflector 5 and the photoconductive drums 21Y, 21C, 21M, 21Bk in the optical path for imaging each of the laser beams LY, LC, LM, LBk onto the circumferential surface of the corresponding drum. The first scanning lens 6 and the second scanning lenses 7 each have such a distortion (fθ characteristics) that the angle of an incident beam is in a proportional relationship with the image height, and a longer dimension in a main scanning direction. These scanning lenses 6, 7 are manufactured by molding a translucent resin material in a metal mold. An optical scanning device according to a modified embodiment may be configured to include three or more scanning lenses.

The first scanning lens 6 is disposed at a position close to the deflector 5 in the optical path and serves as a common scanning lens through which all of the laser beams LY, LC, LM, LBk pass. The first scanning lens 6 includes an incident surface and an exit surface for the light beams that have a positive refractive power both in the main scanning direction and a sub scanning direction. The second scanning lenses 7 (7Y, 7C, 7M, 7Bk) are disposed at positions close to the corresponding photoconductive drums 21Y, 21C, 21M, 21Bk in the optical path. The second scanning lenses 7 are not shared, and the laser beams LY, LC, LM, LBk of the respective colors individually pass the second scanning lenses 7Y, 7C, 7M, 7Bk, respectively.

The collimator lens 41 and the cylindrical lens 42 are disposed between the laser units 4 and the deflector 5 in the optical path. The collimator lens 41 converts laser beams emitted from the laser unit 4 in a diffused manner into parallel beams. The cylindrical lens 42 converts the parallel beams into a linear beam which is long in the main scanning direction to image it on a deflecting surface of the polygon mirror 51.

The plurality of reflection mirrors included in the imaging optical system reflect the laser beams LY, LC, LM, LBk of the respective colors toward the circumferential surfaces of the corresponding photoconductive drums 21Y, 21C, 21M, 21Bk, respectively. After passing through the first scanning lens 6, the yellow laser beam LY is reflected back by a first reflection mirror 431 to further pass through the second scanning lens 7Y, and then reflected upward by a second reflection mirror 432 to fall on the circumferential surface of the photoconductive drum 21Y for yellow through the window portion 232 of the housing 231.

In a similar manner, after passing the first scanning lens 6, the cyan laser beam LC is reflected back by a third reflection mirror 441 to further pass through the second scanning lens 7C, and then reflected by a fourth reflection mirror 442 to fall on the circumferential surface of the photoconductive drum 21C for cyan through the window portion 233. The magenta laser beam LM, after passing through the first scanning lens 6, is reflected back by fifth and sixth reflection mirrors 451, 452 to further pass through the second scanning lens 7M, and then reflected by a seventh reflection mirror 453 to fall on the circumferential surface of the photoconductive drum 21M for magenta through the window portion 234. On the other hand, the black laser beam LBk passes through the first scanning lens 6 and then through the second scanning lens 7Bk to be reflected up by a eighth reflection mirror 46 to fall on the circumferential surface of the photoconductive drum 21Bk for black.

Figure 4:
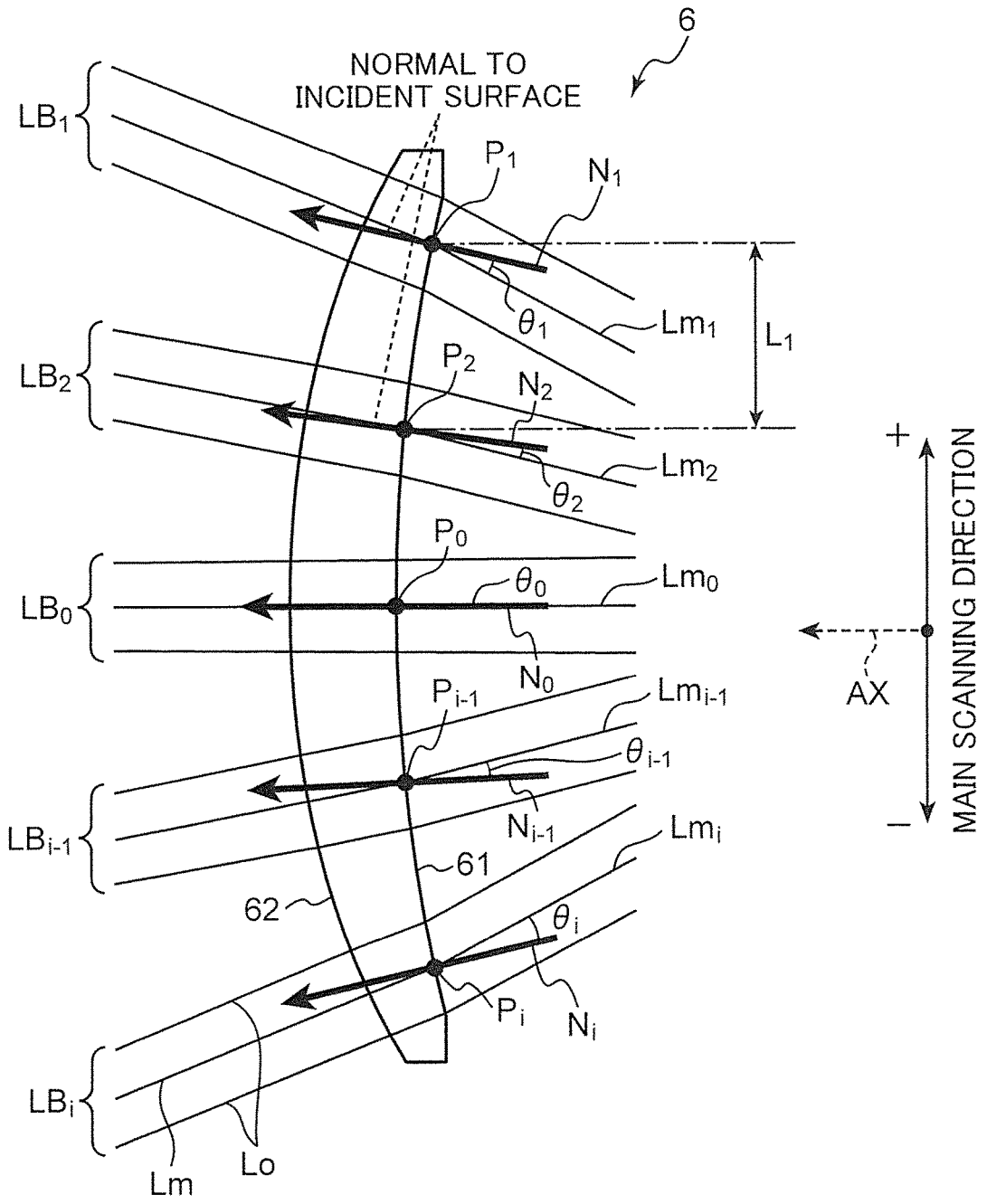
FIG. 4 is a schematic diagram showing oblique angles of a principal ray with respect to the normal to a first scanning lens in a main scanning direction, the first scanning lens being used in the optical scanning device.

Now, the first scanning lens 6 will be described in detail. FIG. 4 shows a main scanning cross section of the first scanning lens 6. FIG. 4 also shows oblique angles θ of an incident principal ray with respect to the normal to the first scanning lens 6 in the main scanning direction. The first scanning lens 6 includes the incident surface 61 where the laser beams enter, and the exit surface 62 where the laser beams go out. In order to image the laser beams, at least one of, preferably both of, the incident surface 61 and the exit surface 62 have a positive refractive power in the main scanning direction as shown in FIG. 4.

Further preferably, at least one of, more preferably both of, the incident surface 61 and the exit surface 62 have a positive refractive power in the sub scanning direction. In a case that the first scanning lens 6 serving as the common scanning lens is made to have an optical power in the sub scanning direction in addition to the main scanning direction, an error in the molding of the first scanning lens 6 or a dimensional error of the metal mold is liable to affect the optical performance. However, if the first scanning lens 6 is made to have no optical power in the sub scanning direction, the sub-scanning magnification of the second scanning lenses 7 will need to be made small, which will increase the difficulty in manufacturing the second scanning lenses 7.

Accordingly, it is desirable to make the first scanning lens 6 have an optical power in the sub scanning direction. On the other hand, the present embodiment is designed to reduce the error sensitivity of the first scanning lens 6, as described later. This configuration can prevent the necessity of excessively increasing the accuracy of the molding and assembling of the first and second scanning lenses 6, 7. This configuration can also allow the scanning lenses 6, 7 to exert an excellent function of making collection against an inclination of the polygon mirror 51.

FIG. 4 illustrates a light beam LB entering the incident surface 61 and exiting out of the exit surface 62 of the first scanning lens 6 at widthwise different positions (image heights) of the lens in the main scanning direction. A light beam LBi shows a principal ray Lm which is a ray passing the center (the center of an unillustrated diaphragm) of the light beam LB, and outermost rays Lo of the light beam LB. Here, incident and exit angles will be described with reference to principal rays Lm of the light beam LB.

The incident surface 61 of the first scanning lens 6 has such a shape as to allow the oblique angle θ of the principal ray Lm entering the incident surface 61 with respect to the normal to the incident surface 61 to vary from a center (disposed on an optical axis AX) to ends (an end of a positive image height and an end of a negative image height) of the first scanning lens 6 in the main scanning direction. In the embodiment shown in FIG. 4, the surface has such a shape as to allow the oblique angle θ to increase from the center to the ends in the main scanning direction. In other words, the incident surface 61 has fθ characteristics.

The exit surface 62 can also be made to have fθ characteristics in a similar manner. Specifically, the exit surface 62 can be shaped in such a manner as to allow the principal ray Lm to go out at a smaller angle than the oblique angle θ with respect to the incident surface 61, with respect to the normal to the exit surface 62. Alternatively, the exit surface 62 may be made to have little fθ characteristics. In this case, the exit surface 62 is shaped in such a manner as to allow the principal ray Lm to go out at an angle substantially equal to the normal to the exit surface 62 over the entire area in the main scanning direction.

In FIG. 4, LB0 indicates the light beam passing through the first scanning lens 6 on the optical axis AX, LB1 indicates the light beam passing through a vicinity of the end of a positive image height (in the lens width direction) from the optical axis AX, LB2 indicates the light beam passing through a vicinity of the middle of the positive image height, LBi-1 indicates the light beam passing through a vicinity of the middle of a negative image height from the optical axis AX, and LBi indicates the light beam passing through a vicinity of the end of the negative image height. N0 indicates the normal to the incident surface 61 at a point P0 at which a principal ray Lm0 of the light beam LB0 enters the first scanning lens 6. An oblique angle θ0 of the principal ray Lm0 with respect to the normal N0 is substantially zero.

A principal ray Lm2 of the light beam LB2 enters the incident surface 61 of the first scanning lens 6 at a point P2 at an oblique angle θ2 with respect to a normal N2 at the point P2. A principal ray Lm1 of the light beam LB1 enters the incident surface 61 at a point P1 at an oblique angle θ1 with respect to a normal N1 at the point P1. Here, the relationship: $\theta 0<\theta 2<\theta 1$ is established. In other words, the oblique angle $\theta$ of the principal ray Lm gradually increases from the axis AX to the positive image height end.

A similar change occurs from the optical axis AX to the negative image height end. Specifically, a principal ray $Lm_{i-1}$ of the light beam $LB_{i-1}$ enters the incident surface 61 at a point $P_{i-1}$ in the vicinity of middle of the negative image height at an oblique angle $\theta_{i-1}$ with respect to a normal $N_{i-1}$ at the point $P_{i-1}$. Further, a principal ray $Lm_i$ of the light beam $LB_i$ enters the incident surface 61 at a point $P_i$ in the vicinity of the end of the negative image height at an oblique angle $\theta_i$ with respect to a normal $N_i$ at the point $P_i$. Here, the relationship: $\theta_0<\theta_{i-1}<\theta_i$ is established.

In the present embodiment, the incident surface 61 satisfies the following conditions, where $\Delta\theta$ is the amount of change and $d\theta$ is the rate of change in the oblique angle $\theta$ of the principal ray Lm in the main scanning direction, $d^2\theta$ is the rate of change in $d\theta$, and $\Delta^2\theta$ is the amount of change in $\Delta\theta$:

$d^2\theta<|0.036|$ when $\Delta^2\theta$ increases from the center to the end in the main scanning direction; and $d^2\theta<|0.061|$ when $\Delta^2\theta$ decreases from the center to the end in the main scanning direction, as becomes apparent from Examples and Comparative Examples described later. Hereinafter, the former case of increase will also be expressed as "$\Delta^2\theta>0$", and the latter case of decrease will also be expressed as "$\Delta^2\theta<0$".

With reference to FIG. 4, the amount of change $\Delta\theta_1$ in the oblique angle $\theta$ between the principal ray $Lm_1$ and the principal ray $Lm_2$ is expressed by the following equation:

$$\Delta\theta_1=\theta_1-\theta_2 \text{(which is generalized as "}\Delta\theta_i\theta_i-\theta_{i-1}\text{")}$$

The rate of change $d\theta_1$ in the oblique angle $\theta$ in this case is expressed by the following equation, where $L_1$ is a planar distance between the point $P_1$ where the principal ray $Lm_1$ enters and the point $P_2$ where the principal ray $Lm_2$ enters:

$$d\theta_1=|\Delta\theta_1/L_1|.$$

When $Lm_3$ is a principal ray passing through an arbitrary point $P_3$ (not shown) lying between the point $P_2$ and the optical axis AX, the amount of change $\Delta\theta_2$ in the oblique angle $\theta$ between the principal ray $Lm_2$ and the principal ray $Lm_3$ is expressed by the following equation: $\Delta\theta_2=\theta_2-\theta_3$. Further, when $L_2$ is a planar distance between the point $P_2$ and the point $P_3$, $d\theta_2=|\Delta\theta_2/L_2|$. In this case, the rate of change $d^2\theta$ in $d\theta$ is expressed by the following equation:

$$\Delta^2\theta_1=\Delta\theta_1-\Delta\theta_2(\Delta^2\theta_i=\Delta\theta_i-\Delta\theta_{i-1}).$$

Further, the amount of change $\Delta^2\theta$ in $\Delta\theta$ is expressed by the following equation:

$$\Delta^2\theta_1=\Delta\theta_1-\Delta\theta_2(\Delta^2\theta_i=\Delta\theta_i-\Delta\theta_{i-1}).$$

Under such definitions, the incident surface 61 is made to satisfy the condition "$d^2\theta<|0.036|$" when $\Delta^2\theta>0$, and the condition "$d^2\theta<|0.061|$" when $\Delta^2\theta<0$, to thereby make it possible to reduce the error sensitivity of the first scanning lens 6. It is particularly meaningful that the influence of an error of the mold on the optical properties of the first scanning lens 6 can be suppressed. Usually, scanning lenses of this type are manufactured by molding a resin material in a metal mold. In this case, an error in the mold may cause a surface displacement between an incident surface and an exit surface.

Figure 5:
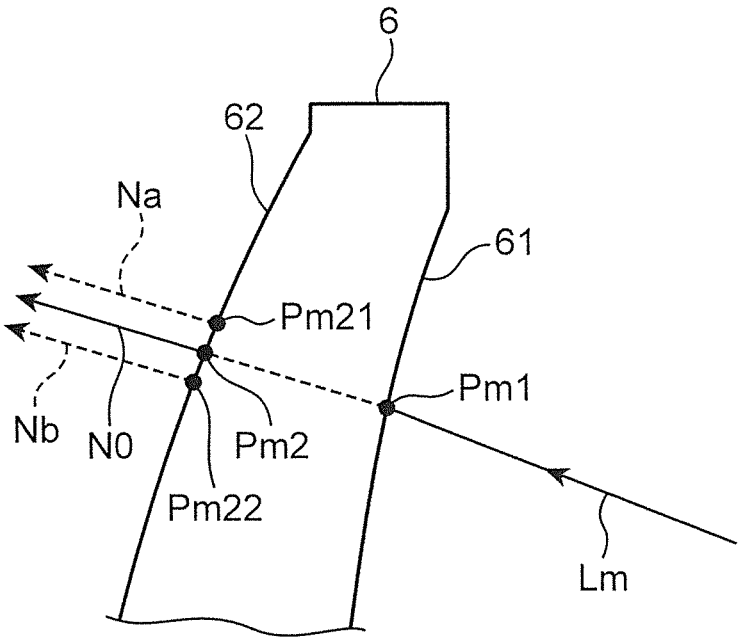
FIG. 5 is a diagram for explaining a surface displacement between an incident surface and an exit surface of a scanning lens.

FIG. 5 is a diagram for explaining a surface displacement between the incident surface 61 and the exit surface 62 of the first scanning lens 6. The surface shapes of the incident surface 61 and the exit surface 62 depend on the accuracy of the metal mold that is used for molding the first scanning lens 6. The metal mold is liable to have a dimensional error, which influences on the surface shapes. For example, the surface shapes are designed in such a way as to allow the principal ray Lm to enter the incident surface 61 at a point Pm1 and exit out of the exit surface 62 at a point Pm2.

Here, if a surface displacement occurs between the incident surface 61 and the exit surface 62 due to an error of the mold, for example, if the exit surface 62 is displaced with respect to the incident surface 61 toward the center of an image height, a position of the exit surface 62 that corresponds to the point Pm1 of the incident surface 61 is, not the point Pm2, but a point Pm21 adjacent to the side of the point Pm2 closer to an image height end. On the contrary, if the exit surface 62 is displaced with respect to the incident surface 61 toward the image height end, a position of the exit surface 62 that corresponds to the point Pm1 of the incident surface 61 is a point Pm22 adjacent to the side of the point Pm2 closer to the center of the image height.

In a case that the exit surface 62 is shaped, similarly to the incident surface 61, in a such a manner as to allow the oblique angle $\theta$ of the principal ray Lm with respect to the normal gradually increases from the center to the end of the image height, the above-mentioned surface displacement either from the point Pm2 to the point Pm 21 or from the point Pm2 to the point Pm22 greatly influences on the optical properties, such as a field curvature, of the first scanning lens 6. This is due to the design in which the oblique angle $\theta$ differs between the point Pm2 and the point Pm 21 or the point Pm 22. However, in the present embodiment, the incident surface 61 is made to satisfy the above-described relationship between $\Delta 2\theta$ and $d2\theta$ to thereby make it possible to reduce the influence of the first scanning lens 6 on the optical properties even in the case of occurrence of a surface displacement such as the one described above.

EXAMPLE 1

Case of $\Delta^2\theta<0>$

Now, Example 1 shows exemplary construction data of an imaging optical system that satisfies the requirements of the optical scanning device 23 according to the above-described embodiment. An imaging optical system according to Example 1 is configured such that a laser unit 4, a collimator lens 41, a cylindrical lens 42, a deflector 5, a first scanning lens 6 common for all colors, and second scanning lenses 7 (7Y, 7C, 7M, 7Bk) for respective colors are arranged in this order, as shown in FIG. 3. Table 1 shows face-to-face distances in the imaging optical system and main scanning/sub-scanning radii of curvature of the first scanning lens 6 and the second scanning lenses 7 according to Example 1. Further, Table 2 shows the surface shapes of the first scanning lens 6 and the second scanning lenses 7 of Example 1.

| | Face-to-face distance | Main scanning radius of curvature | Sub-scanning radius of curvature | Refractive index |
|---|---|---|---|---|
| Deflector | 38.12 | | | |
| Lens I Incident surface | 9.5 | −94.451 | −800 | 1.5072 |
| Exit surface | | −57.754 | −130 | |
| | 200 | | | |
| Lens II Incident surface | 4 | −488.078 | 73.65 | 1.5072 |

-continued

| | | | | |
|---|---|---|---|---|
| Exit surface | | | 3000 | −90 |
| Photoconductive member | 90 | | | |

| | Lens I | | Lens II | |
|---|---|---|---|---|
| | Incident surface | Exit surface | Incident surface | Exit surface |
| Rm0 | −94.451 | −57.754 | −488.078 | 3000 |
| K | 2.177 | −1.073 | −9.023599 | 0 |
| A4 | 4.71E−07 | −4.93E−07 | 4.34E−08 | 0.00E+00 |
| A6 | −8.11E−11 | −1.42E−10 | −8.51E−13 | 0.00E+00 |
| A8 | 8.63E−14 | 1.29E−14 | 8.50E−18 | 0 |
| A10 | −5.36E−16 | −2.33E−16 | −2.23E−23 | 0 |
| Rs0 | −800 | −130 | 73.65 | −90 |
| B1 | | | 0.0008356 | 0 |
| B2 | | | 0 | 0 |
| B3 | | | 7.05E−08 | 0 |
| B4 | | | 0.00E+00 | 0.00E+00 |
| B5 | | | −3.94E−12 | 0 |
| B6 | | | 0.00E+00 | 0.00E+00 |

In Tables 1 and 2, "Lens 1" and "Lens 2" indicate the first scanning lens 6 and the second scanning lens 7, respectively. In Table 2, the main scanning radius of curvature and the sub-scanning radius of curvature are indicated as Rm0 and Rs0 respectively. K indicates the main scanning conic coefficient, An and Bn (n is an integer) indicate high-order coefficients of the surface shapes (the same applies to the tables provided below).

The respective surface shapes of the incident surface and the exit surface of each of the first scanning lens 6 and the second scanning lenses 7 are defined based on the following formula showing the sag amount by using a local orthogonal coordinate system (x, y, z) with the surface vertex as the origin and the direction toward the photoconductive drums 21 as the positive direction of the axis z. It should be noted that Zm (main scanning direction) and Zs (sub scanning direction) each indicate the amount of displacement (surface vertex reference) in the Z axis direction at the position of height Y.

$$Sag = Zm + Zs$$

$$Zm = \frac{C_{m0} \times y^2}{1 + \sqrt{(1 - (1 + K) \times C_{m0}^2 \times y^2)}} + A4 \times y^4 + A6 \times y^6 + A8 \times y^8 + A10 \times y^{10}$$

$$C_{m0} = 1 / R_{m0}$$

$$Rs = R_{S0} + \sum_{i=1}^{6} Bi \times y^i$$

$$Zs = Rs \times \left(1 - \sqrt{1 - \frac{x^2}{R_{S0}^2}}\right)$$

Figure 6:
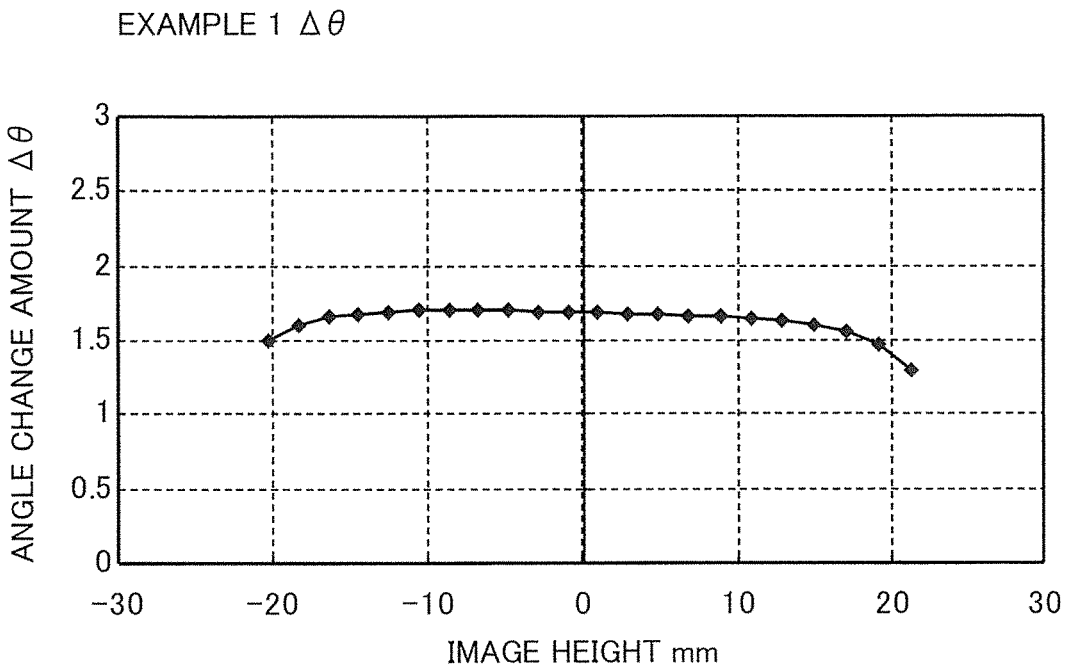
FIG. 6 is a graph showing the amount of change Δθ in the oblique angle θ of a principal ray with respect to the normal to an incident surface of a first scanning lens in a main scanning direction, the lens having been used in Example 1.
Figure 7:
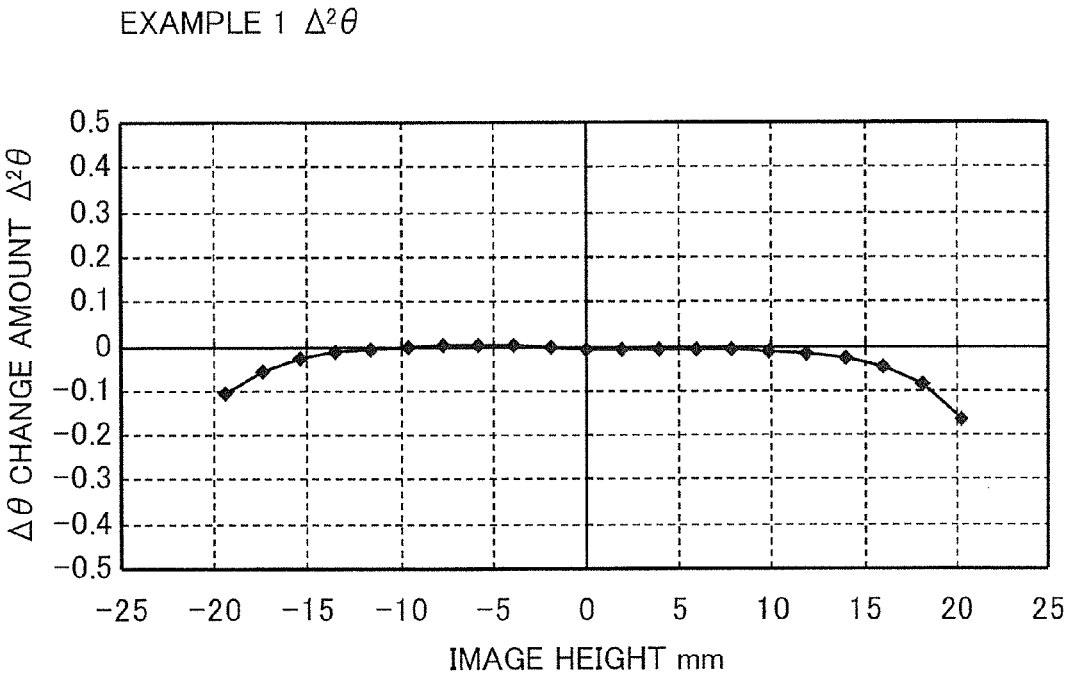
FIG. 7 is a graph showing the amount of change Δ2θin Δθ.
Figure 8:
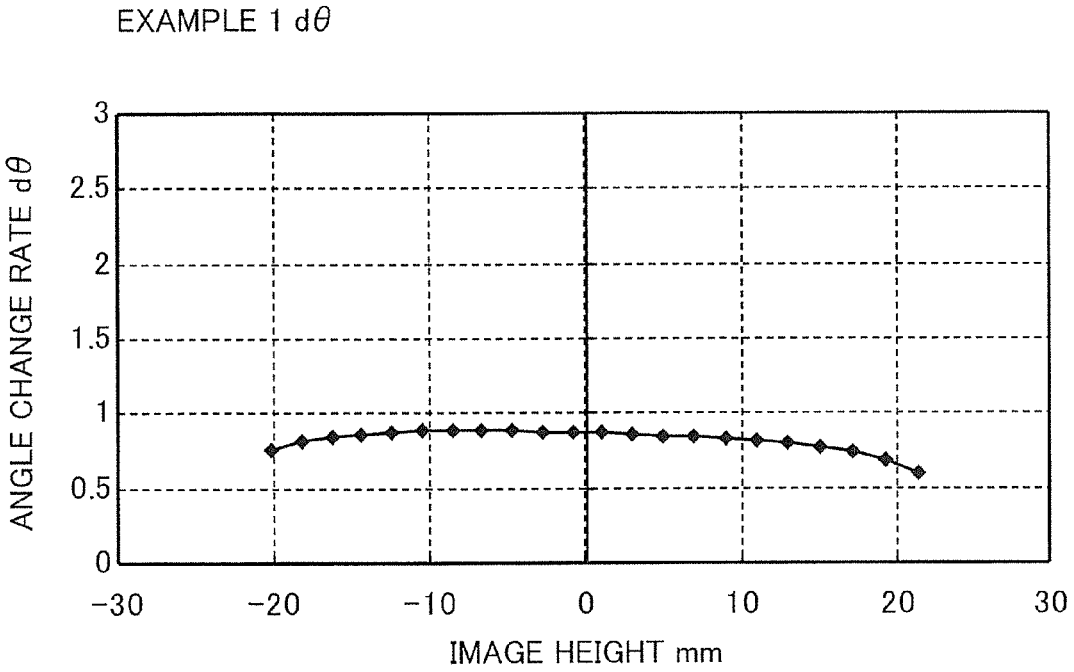
FIG. 8 is a graph showing the rate of change dθ in the oblique angle θ.

FIG. 6 is a graph showing the amount of change Δθ in the oblique angle θ of an incident light beam with respect to the normal to an incident surface 61 of the first scanning lens 6 in a main scanning direction, the lens having been used in Example 1. FIG. 7 is a graph showing the amount of change $\Delta^2\theta$in Δθ. As seen from FIG. 7, $\Delta^2\theta$ is substantially zero at the point where the image height=0 mm. On the other hand, $\Delta^2\theta$ is about −0.1 at the point where the image height=about −20 mm, and $\Delta^2\theta$ is about −1.8 at the point where the image height=about +20 mm. In other words, $\Delta^2\theta$ decreases from the center to the ends in the main scanning direction (the case of $\Delta^2\theta<0$). FIG. 8 is a graph showing the rate of change dθ in the oblique angle θ with respect to the incident surface 61 according to Example 1 in the main scanning direction.

Figure 9:
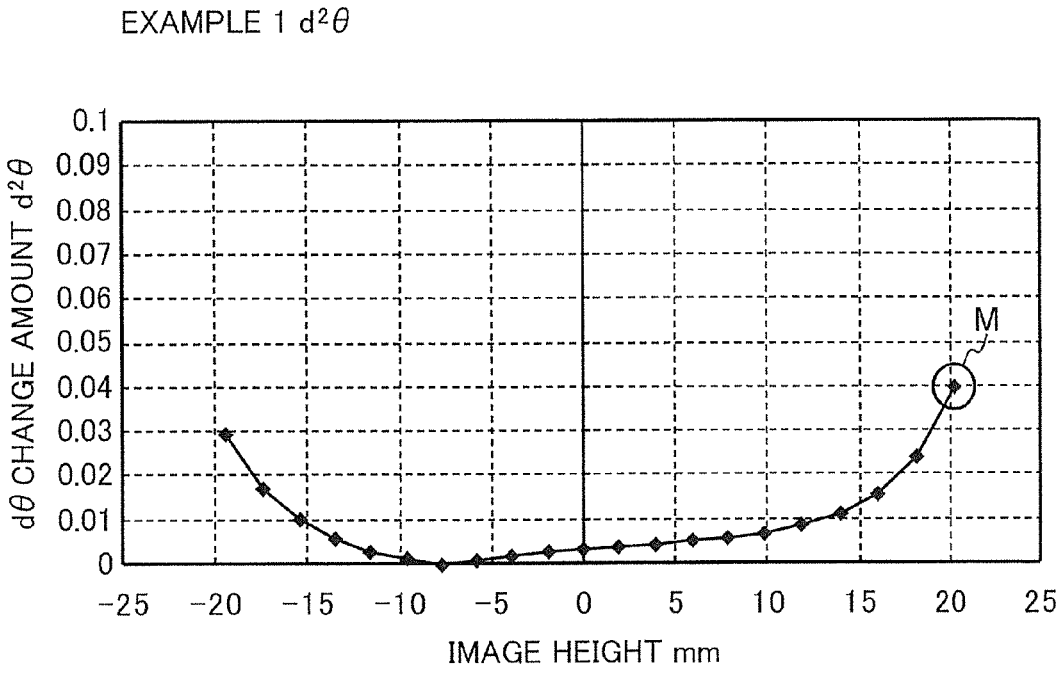
FIG. 9 is a graph showing the rate of change d2θ in dθ.

FIG. 9 is a graph showing the rate of change $d^2\theta$ in the above-shown dθ. The maximum value of $d^2\theta$ is at the point where the image height=+20 mm on the first scanning lens 6 as indicated by the reference character M in FIG. 9, which is $d^2$=0.040. In the present embodiment, the maximum value of $d^2\theta$ is required to be equal to or less than the above-defined reference value. In the case of $\Delta^2\theta<0$, the reference value is $d^2\theta<|0.061|$ as mentioned above, and therefore Example 1 satisfies the requirement.

Figure 10:
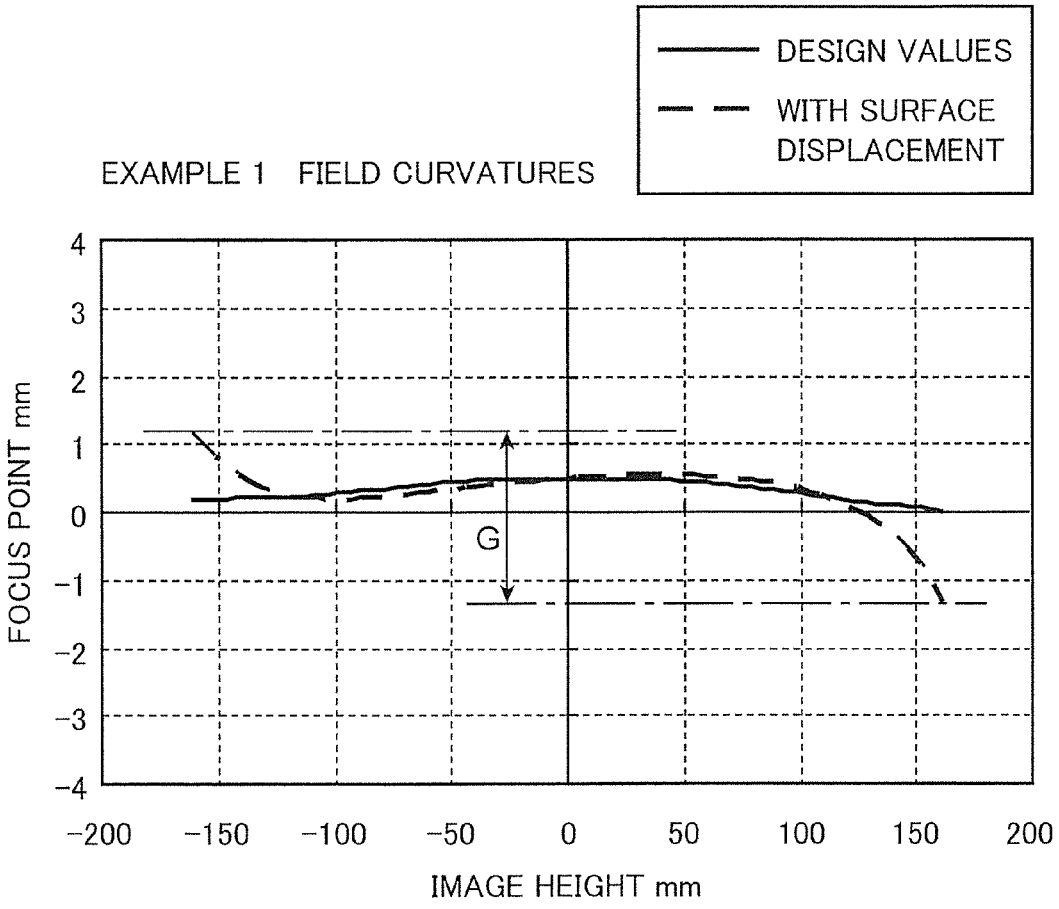
FIG. 10 is a graph showing field curvatures of an optical scanning device according to Example 1.

FIG. 10 is a graph showing field curvatures of the imaging optical system according to Example 1 in the main scanning direction. The graph shows a field curvature of the case where the incident surface 61 and the exit surface 62 of the first scanning lens 6 face each other at design values ("design values": the case where no surface displacement occurs) and a filed curvature of the case where there is a surface displacement of 50 μm between these surfaces ("with a surface displacement"). The eccentricity of 50 μm is the amount that needs to be taken into account as an error of a mold for stable production of scanning lenses. A surface displacement of about 50 μm between the incident surface and the exit surface causes a shift of the focus point of 4 mm in the entire image height of the scanning lens. Accordingly, a surface displacement causing a field curvature of such or less degree is permissible in this type of optical scanning device.

In FIG. 10, the filed curvature in the main scanning direction in the case of "design values" is about 0.5 mm or less over the entire image height, and therefore allows good optical properties. Further, even in the case of "with a surface displacement", the maximum focus point shift amount G (an indicator of the degree of a surface displacement from a design value) is about 2.3 mm, the maximum focus point shift amount G being a difference between the point where the focus point is shifted to the maximum distance in the positive direction (near a point where the image height on the drum circumferential surface=−160 mm) and the point where the focus point is shifted to the maximum distance in the negative direction (near a point where the image height on the drum circumferential surface=+160 mm). Accordingly, it is confirmed that the first scanning lens 6 of Example 1 is at a level that causes no problem in practical use.

EXAMPLE 2

Case of $\Delta^2\theta<0>$

Exemplary construction data of an imaging optical system according to Example 2 is shown in Tables 3 and 4. The optical arrangement of the imaging optical system according to Example 2 is the same as that of Example 1 (the arrangement shown in FIG. 3). Table 3 shows face-to-face distances in the imaging optical system and main scanning/sub-scanning radii of curvature of a first scanning lens 6 and second scanning lenses 7 according to Example 2. Table 4 shows the surface shapes of the first scanning lens 6 and the second scanning lenses 7 of Example 2.

| | Face-to-face | Main scanning radius of | Sub-scanning radius of | Refractive |
|---|---|---|---|---|

-continued

| | distance | curvature | curvature | index |
|---|---|---|---|---|
| Deflector | 38 | | | |
| Lens I Incident surface | 9.5 | −110.869 | −600 | 1.5072 |
| Exit surface | | −63.399 | −130 | |
| | 223 | | | |
| Lens II Incident surface | 4 | −520.679 | 73.65 | 1.5072 |
| Exit surface | | 5000 | −90 | |
| | 59 | | | |
| Photoconductive member | | | | |

| | Lens I | | Lens II | |
|---|---|---|---|---|
| | Incident surface | Exit surface | Incident surface | Exit surface |
| Rm0 | −110.869 | −63.399 | −520.679 | 5000 |
| K | 1.946 | −1.366 | 0.0337833 | 0 |
| A4 | 6.69E−07 | −2.92E−07 | 5.14E−08 | 0.00E+00 |
| A6 | −3.02E−10 | −8.14E−11 | −8.95E−13 | 0.00E+00 |
| A8 | 4.75E−13 | 3.09E−14 | 1.17E−17 | 0 |
| A10 | −5.78E−16 | −8.27E−17 | −7.21E−23 | 0 |
| Rs0 | −600 | −130 | 73.65 | −90 |
| B1 | | | 0.0008356 | 0 |
| B2 | | | 0 | 0 |
| B3 | | | 7.05E−08 | 0 |
| B4 | | | 0.00E+00 | 0.00E+00 |
| B5 | | | −3.94E−12 | 0 |
| B6 | | | 0.00E+00 | 0.00E+00 |

Figure 11:
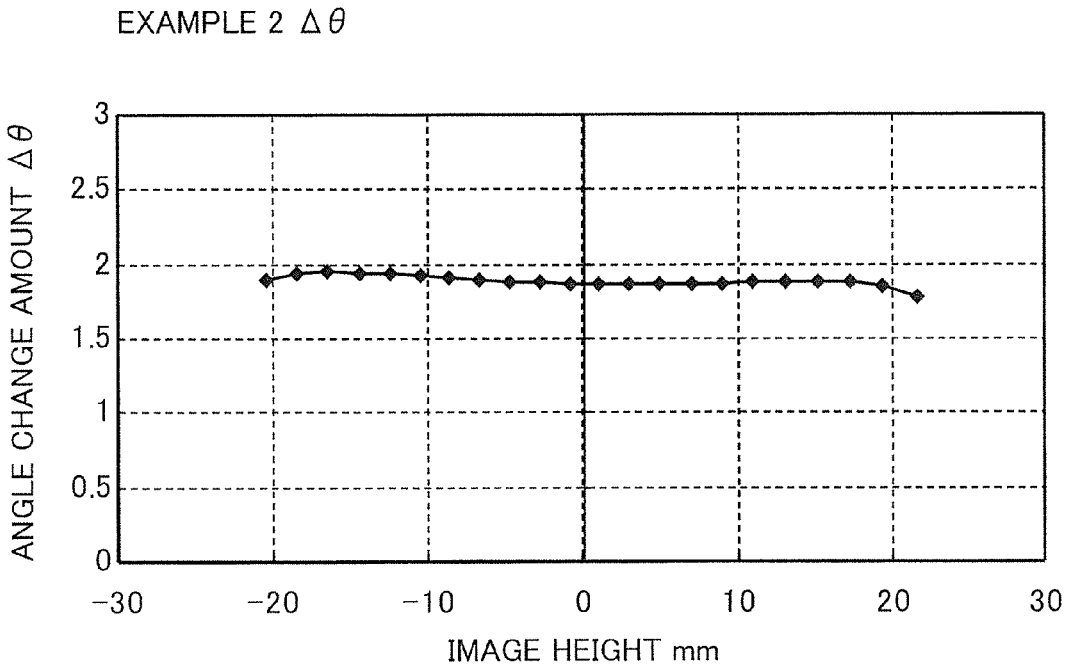
FIG. 11 is a graph showing the amount of change Δθ in the oblique angle θ of a principal ray with respect to the normal to an incident surface of a first scanning lens in a main scanning direction, the lens having been used in Example 2.
Figure 12:
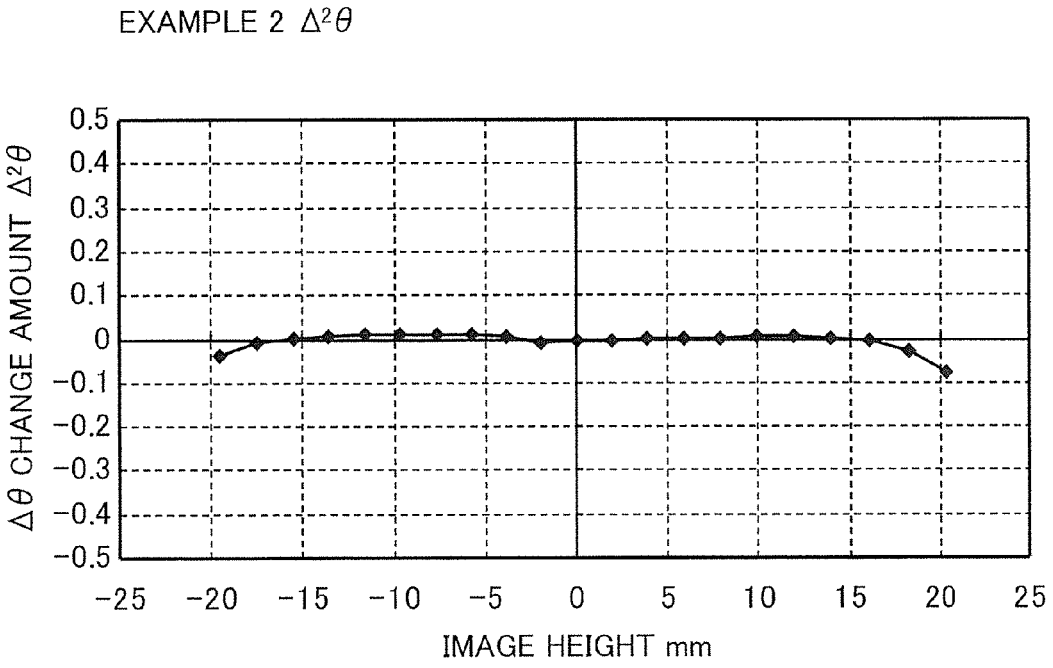
FIG. 12 is a graph showing the amount of change Δ2θin Δθ.
Figure 13:
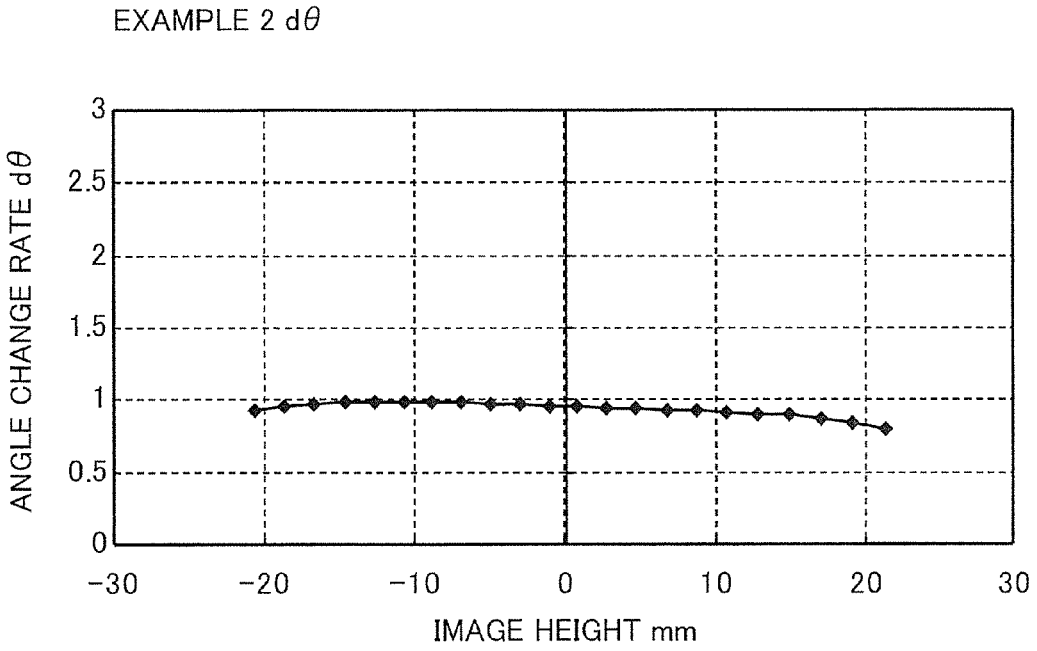
FIG. 13 is a graph showing the rate of change dθ in the oblique angle θ.

FIG. 11 is a graph showing the amount of change Δθ in the oblique angle θ of a light beam incident on an incident surface 61 of the first scanning lens 6 used in Example 2. FIG. 12 is a graph showing the amount of change Δ2θ in Δθ. As seen from FIG. 12, Δ2θ changes in the negative direction at ends of an image height, compared to the point where the image height=0 mm. In other words, Δ2θ decreases from the center to the ends in a main scanning direction (the case of Δ2θ<0). FIG. 13 is a graph showing the rate of change dθ in the oblique angle θ with respect to the incident surface 61 according to Example 2 in the main scanning direction.

Figure 14:
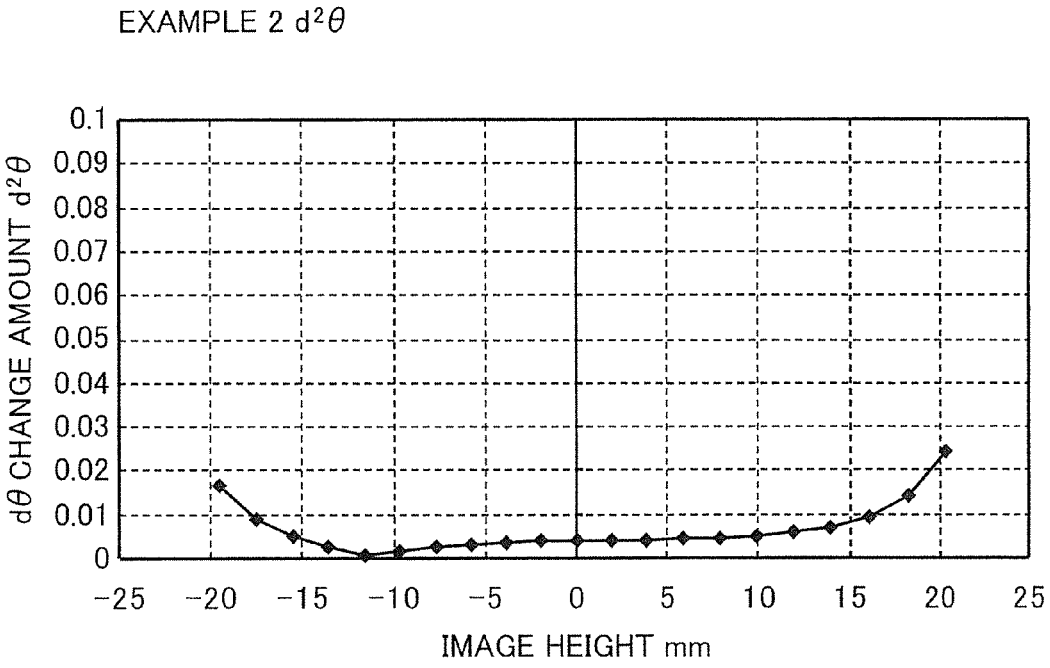
FIG. 14 is a graph showing the rate of change d2θin dθ.
Figure 15:
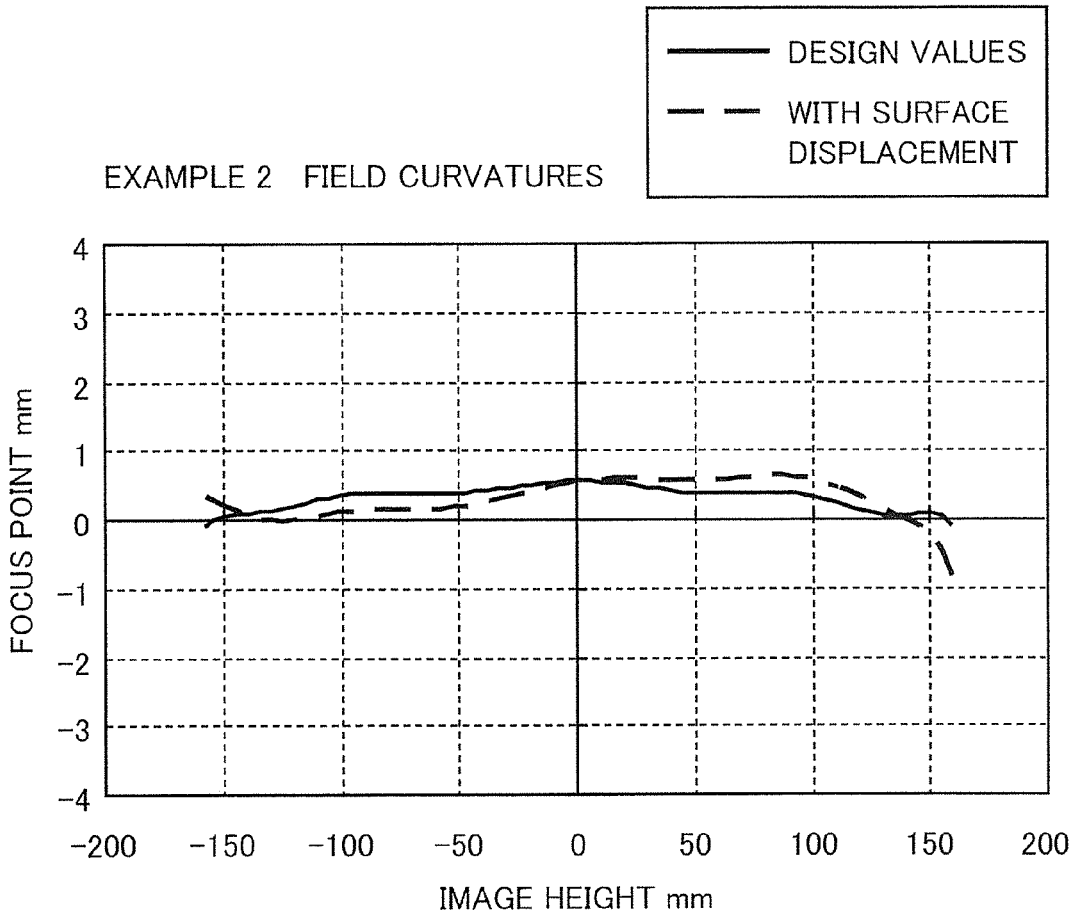
FIG. 15 is a graph showing field curvatures of an optical scanning device according to Example 2.

FIG. 14 is a graph showing the rate of change d2θ in the above-shown dθ. The maximum value of d2θ is at the point where the image height=+20 mm, which is about d2θ=0.024. Therefore, Example 2 satisfies the condition defined by the reference value: $d^2\theta<|0.061|$. FIG. 15 is a graph showing field curvatures of the imaging optical system according to Example 2 in the main scanning direction. In FIG. 15, it is not only that a field curvature in the main scanning direction is good over the entire image height in the case of "design values", but also in the case of "with a surface displacement", the maximum focus point shift amount G is about 1.2 mm. Accordingly, it is confirmed that the first scanning lens 6 of Example 2 is at a level that causes no problem in practical use.

EXAMPLE 3

Case of $\Delta^2\theta<0>$

Exemplary construction data of an imaging optical system according to Example 3 is shown in Tables 5 and 6. The optical arrangement of the imaging optical system according to Example 3 is the same as that of Example 1 (the arrangement shown in FIG. 3). Table 5 shows face-to-face distances in the imaging optical system and main scanning/sub-scanning radii of curvature of a first scanning lens 6 and second scanning lenses 7 according to Example 3. Table 6 shows the surface shapes of the first scanning lens 6 and the second scanning lenses 7 of Example 3.

| | Face-to-face distance | Main scanning radius of curvature | Sub-scanning radius of curvature | Refractive index |
|---|---|---|---|---|
| Deflector | 37.56 | | | |
| Lens I Incident surface | 9.5 | −102.572 | −800 | 1.5072 |
| Exit surface | | −59.992 | −300 | |
| | 200.2 | | | |
| Lens II Incident surface | 4 | −430.667 | 73.65 | 1.5072 |
| Exit surface | | 3000 | −60 | |
| | 76.8 | | | |
| Photoconductive member | | | | |

| | Lens I | | Lens II | |
|---|---|---|---|---|
| | Incident surface | Exit surface | Incident surface | Exit surface |
| Rm0 | −102.572 | −59.992 | −430.667 | 3000 |
| K | 1.313 | −1.343 | −3.87974 | 0 |
| A4 | 7.43E−07 | −2.89E−07 | 5.38E−08 | 0.00E+00 |
| A6 | −1.27E−10 | 6.90E−12 | −1.10E−12 | 0.00E+00 |
| A8 | 3.83E−13 | 6.77E−14 | 1.28E−17 | 0 |
| A10 | −5.50E−16 | −1.01E−16 | −5.20E−23 | 0 |
| Rs0 | −800 | −300 | 73.65 | −60 |
| B1 | | | 0.0008356 | 0 |
| B2 | | | 0 | 0 |
| B3 | | | 7.05E−08 | 0 |
| B4 | | | 0.00E+00 | 0.00E+00 |
| B5 | | | −3.94E−12 | 0 |
| B6 | | | 0.00E+00 | 0.00E+00 |

Figure 16:
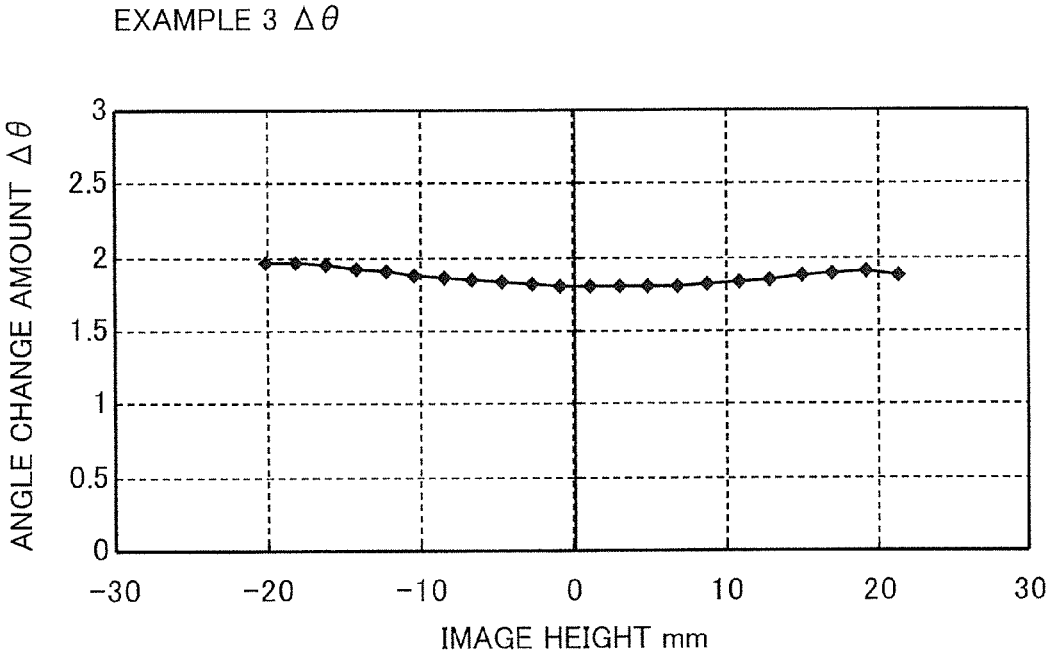
FIG. 16 is a graph showing the amount of change Δθ in the oblique angle θ of a principal ray with respect to the normal to an incident surface of a first scanning lens in a main scanning direction, the lens having been used in Example 3.
Figure 17:
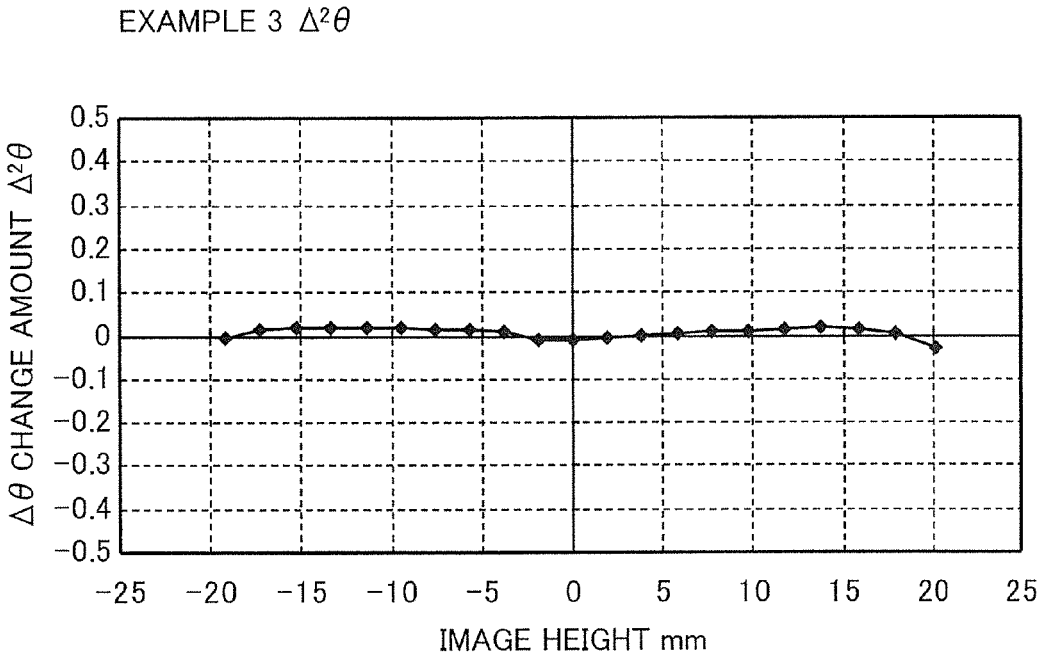
FIG. 17 is a graph showing the amount of change Δ2θ in Δθ.
Figure 18:
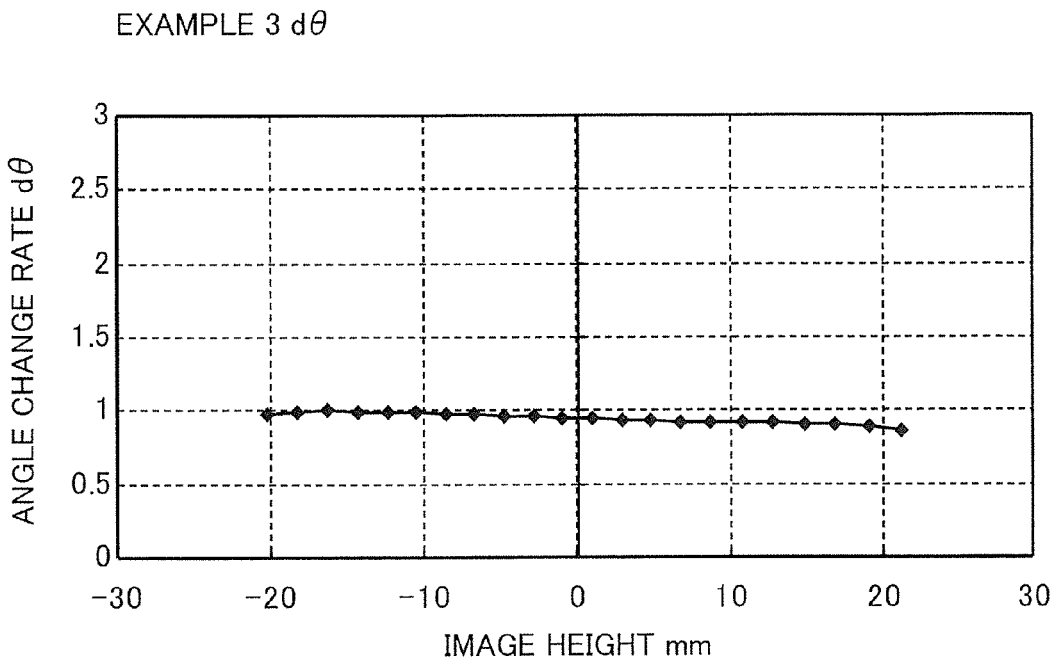
FIG. 18 is a graph showing the rate of change dθ in the oblique angle θ.

FIG. 16 is a graph showing the amount of change Δθ in the oblique angle θ of a light beam incident on an incident surface 61 of the first scanning lens 6 used in Example 3. FIG. 17 is a graph showing the amount of change Δ2θ in Δθ. As seen from FIG. 17, Δ2θ changes in the negative direction at ends of an image height, compared to the point where the image height=0 mm. In other words, Δ2θ decreases from the center to the ends in a main scanning direction (the case of Δ2θ<0). FIG. 18 is a graph showing the rate of change dθ in the oblique angle θ with respect to the incident surface 61 according to Example 3 in the main scanning direction.

Figure 19:
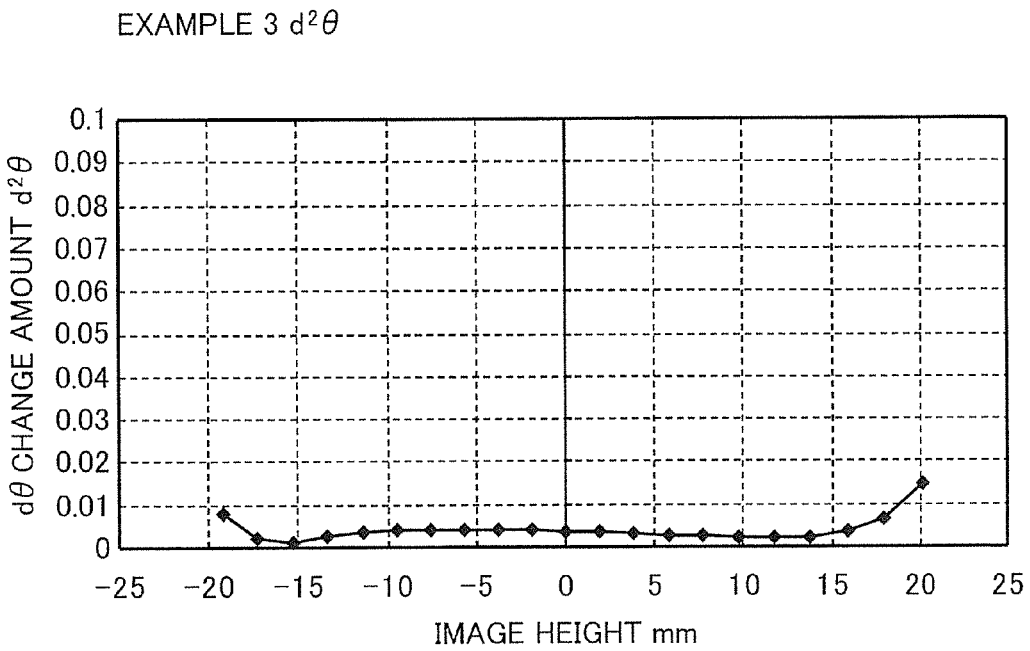
FIG. 19 is a graph showing the rate of change d2θ in dθ.
Figure 20:
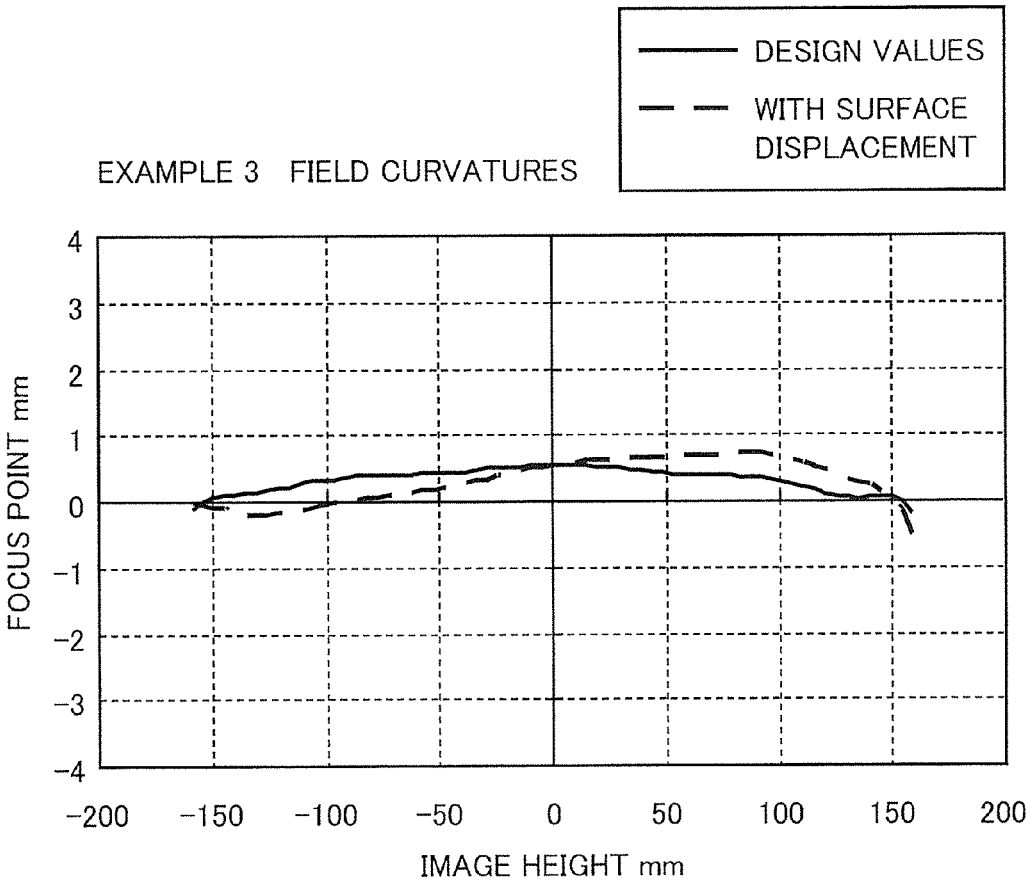
FIG. 20 is a graph showing field curvatures of an optical scanning device according to Example 3.

FIG. 19 is a graph showing the rate of change d2θ in the above-shown dθ. The maximum value of d2θ is at the point where the image height=+20 mm, which is about d2θ=0.015. Therefore, Example 3 satisfies the condition defined by the reference value: d2θ<|0.061|. FIG. 20 is a graph showing field curvatures of the imaging optical system according to Example 3 in the main scanning direction. In FIG. 20, it is not only that a field curvature in the main scanning direction is good over the entire image height in the case of "design values", but also in the case of "with a surface displacement", the maximum focus point shift amount G is about 1.0 mm. Accordingly, it is confirmed that the first scanning lens 6 of Example 3 is at a level that causes no problem in practical use.

EXAMPLE 4

Case of $\Delta^2\theta>0>$

Exemplary construction data of an imaging optical system according to Example 4 is shown in Tables 7 and 8. The optical arrangement of the imaging optical system according to Example 4 is the same as that of Example 1 (the arrangement shown in FIG. 3). Table 7 shows face-to-face distances in the imaging optical system and main scanning/sub-scanning radii of curvature of a first scanning lens 6 and second scanning lenses 7 according to Example 4. Table 8 shows the surface shapes of the first scanning lens 6 and the second scanning lenses 7 of Example 4.

| | Face-to-face distance | Main scanning radius of curvature | Sub-scanning radius of curvature | Refractive index |
|---|---|---|---|---|
| Deflector | 38 | | | |
| Lens I Incident surface | 9.5 | −117.595 | −800 | 1.5072 |
| Exit surface | | −64.631 | −130 | |
| | 200 | | | |
| Lens II Incident surface | 4 | −488.078 | 73.65 | 1.5072 |
| Exit surface | | 3000 | −90 | |
| | 90 | | | |
| Photoconductive member | | | | |

| | Lens I | | Lens II | |
|---|---|---|---|---|
| | Incident surface | Exit surface | Incident surface | Exit surface |
| Rm0 | −117.595 | −64.631 | −488.078 | 3000 |
| K | 0.292 | −1.699 | −9.023599 | 0 |
| A4 | 8.93E−07 | −1.16E−07 | 4.34E−08 | 0.00E+00 |
| A6 | −5.00E−11 | 1.72E−10 | −8.51E−13 | 0.00E+00 |
| A8 | 6.03E−13 | 1.26E−13 | 8.50E−18 | 0 |
| A10 | −5.38E−16 | 9.38E−18 | −2.23E−23 | 0 |
| Rs0 | −800 | −130 | 73.65 | −90 |
| B1 | | | 0.0008356 | 0 |
| B2 | | | 0 | 0 |
| B3 | | | 7.05E−08 | 0 |
| B4 | | | 0.00E+00 | 0.00E+00 |
| B5 | | | −3.94E−12 | 0 |
| B6 | | | 0.00E+00 | 0.00E+00 |

Figure 21:
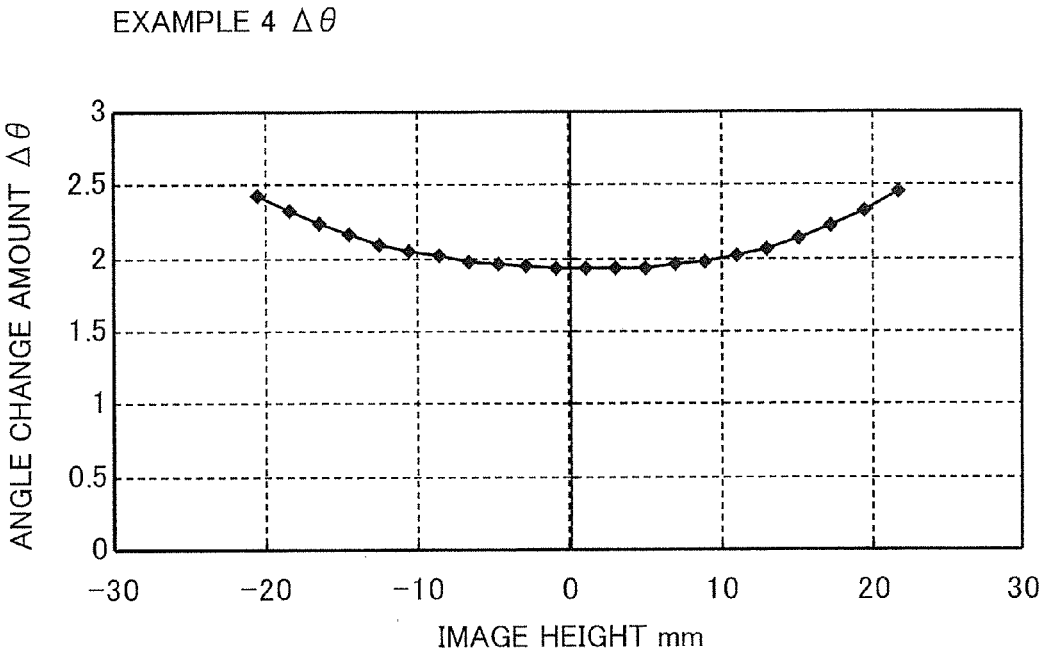
FIG. 21 is a graph showing the amount of change Δθ in the oblique angle θ of a principal ray with respect to the normal to an incident surface of a first scanning lens in a main scanning direction, the lens having been used in Example 4.
Figure 22:
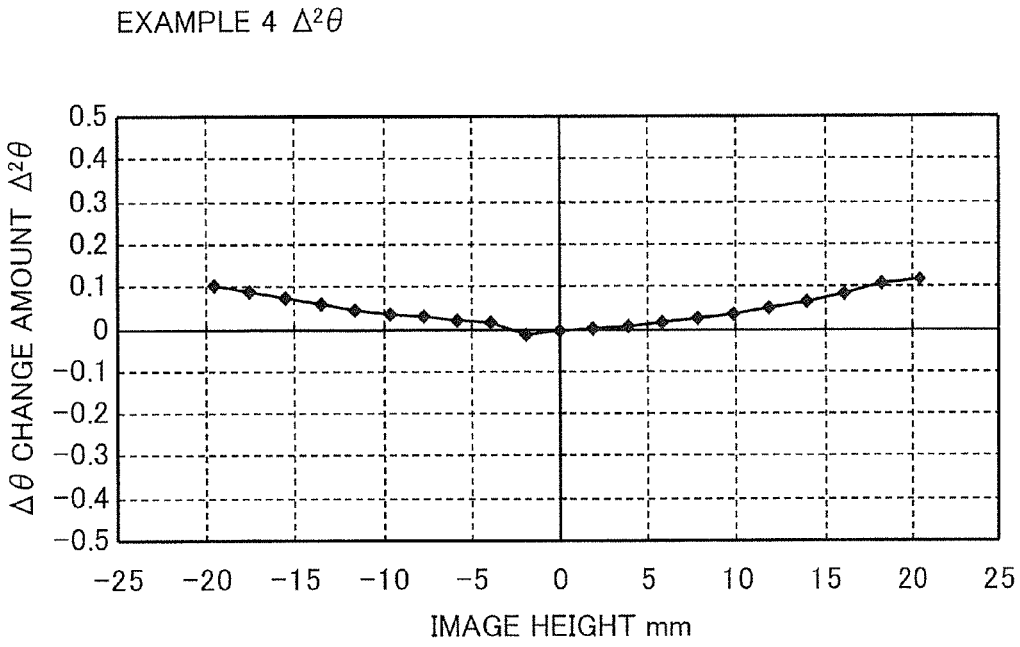
FIG. 22 is a graph showing the amount of change Δ2θ in Δθ.
Figure 23:
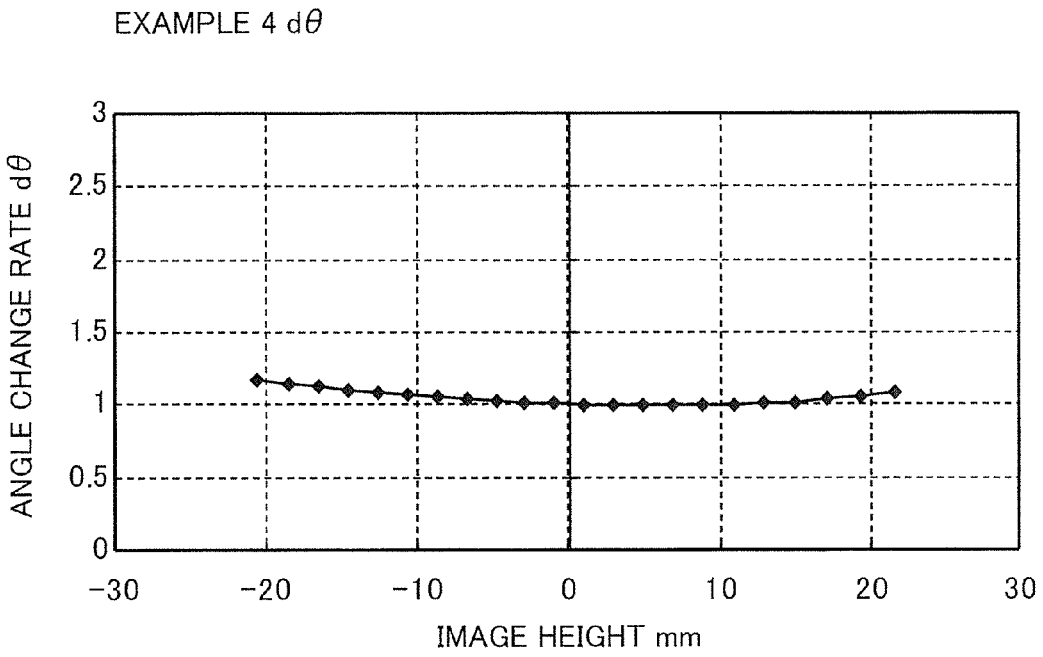
FIG. 23 is a graph showing the rate of change dθ in the oblique angle θ.

FIG. 21 is a graph showing the amount of change Δθ in the oblique angle θ of a light beam incident on an incident surface 61 of the first scanning lens 6 used in Example 4. FIG. 22 is a graph showing the amount of change Δ2θ in Δθ. As seen from FIG. 22, Δ2θ changes in the positive direction at ends of an image height, compared to the point where the image height=0 mm. In other words, Δ2θ increases from the center to the ends in a main scanning direction (the case of Δ2θ>0). FIG. 23 is a graph showing the rate of change dθ in the oblique angle θ with respect to the incident surface 61 according to Example 4 in the main scanning direction.

Figure 24:
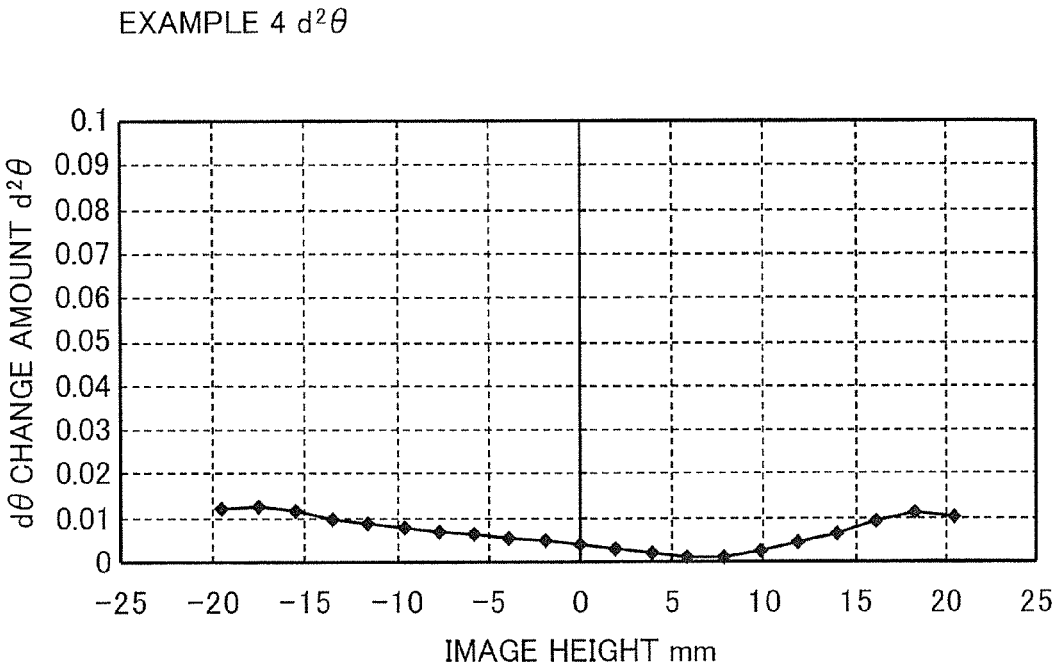
FIG. 24 is a graph showing the rate of change d2θ in dθ.
Figure 25:
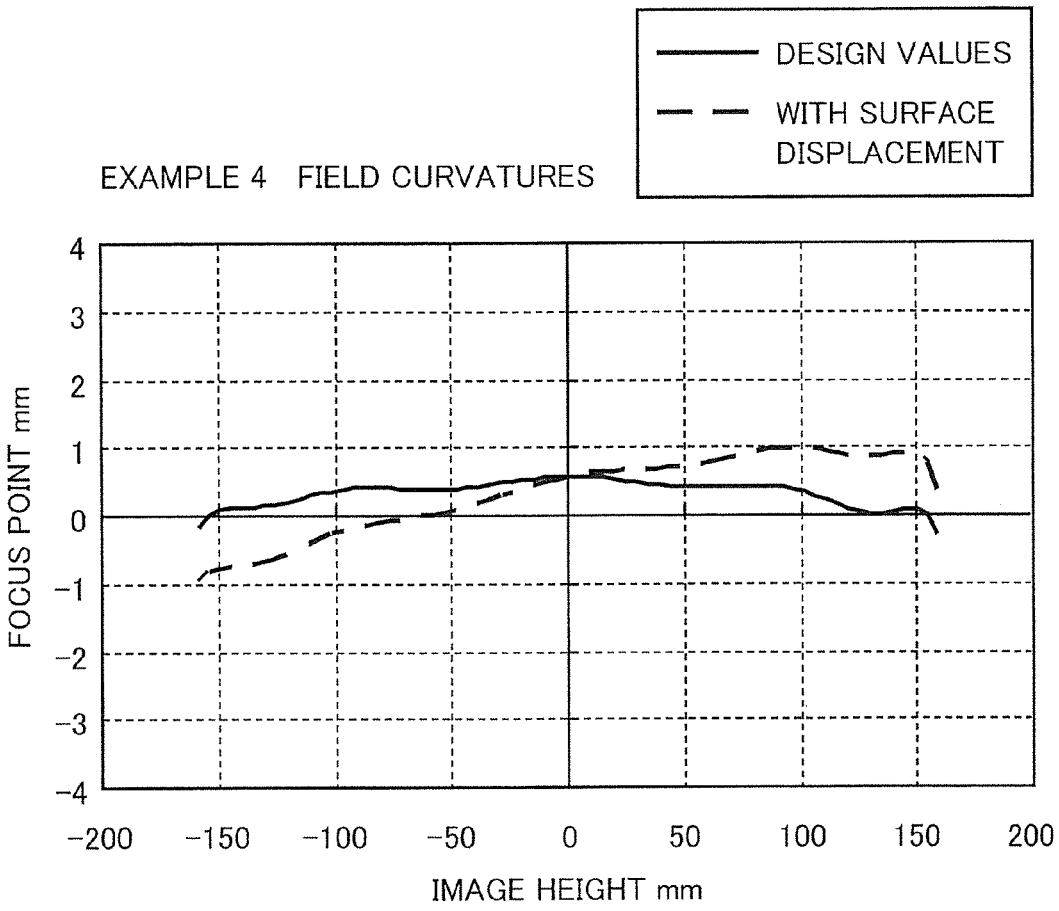
FIG. 25 is a graph showing field curvatures of an optical scanning device according to Example 4.

FIG. 24 is a graph showing the rate of change d2θ in the above-shown dθ. The maximum value of $d^2\theta$ is at the point where the image height=±18 mm, which is about $d^2\theta=0.011$. Therefore, Example 4 satisfies the condition defined by the reference value: $d^2<|0.036|$. FIG. 25 is a graph showing field curvatures of the imaging optical system according to Example 4 in the main scanning direction. In FIG. 25, it is not only that a field curvature in the main scanning direction is good over the entire image height in the case of "design values", but also in the case of "with a surface displacement", the maximum focus point shift amount G is equal to or less than about 2.0 mm. Accordingly, it is confirmed that the first scanning lens 6 of Example 4 is at a level that causes no problem in practical use.

EXAMPLE 5

Case of $\Delta^2\theta>0>$

Exemplary construction data of an imaging optical system according to Example 5 is shown in Tables 9 and 10. The optical arrangement of the imaging optical system according to Example 5 is the same as that of Example 1 (the arrangement shown in FIG. 3). Table 9 shows face-to-face distances in the imaging optical system and main scanning/sub-scanning radii of curvature of a first scanning lens 6 and second scanning lenses 7 according to Example 5. Table 10 shows the surface shapes of the first scanning lens 6 and the second scanning lenses 7 of Example 5.

| | Face-to-face distance | Main scanning radius of curvature | Sub-scanning radius of curvature | Refractive index |
|---|---|---|---|---|
| Deflector | 38.4 | | | |
| Lens I Incident surface | 9.5 | −140.476 | −800 | 1.5072 |
| Exit surface | | −70.522 | −130 | |
| | 200 | | | |
| Lens II Incident surface | 4 | −278.900 | 73.65 | 1.5072 |
| Exit surface | | 3000 | −90 | |
| | 77 | | | |
| Photoconductive member | | | | |

| | Lens I | | Lens II | |
|---|---|---|---|---|
| | Incident surface | Exit surface | Incident surface | Exit surface |
| Rm0 | −140.476 | −70.522 | −278.900 | 3000 |
| K | −0.783 | −2.084 | −3.486478 | 0 |
| A4 | 9.89E−07 | 3.61E−09 | 5.42E−08 | 0.00E+00 |
| A6 | −1.15E−10 | 2.32E−10 | −1.11E−12 | 0.00E+00 |
| A8 | 8.98E−13 | 1.88E−13 | 1.79E−17 | 0 |
| A10 | −5.65E−16 | 9.58E−17 | −1.76E−22 | 0 |
| Rs0 | −800 | −130 | 73.65 | −65 |
| B1 | | | 0.0008356 | 0 |
| B2 | | | 0 | 0 |
| B3 | | | 7.05E−08 | 0 |
| B4 | | | 0.00E+00 | 0.00E+00 |
| B5 | | | −3.94E−12 | 0 |
| B6 | | | 0.00E+00 | 0.00E+00 |

Figure 26:
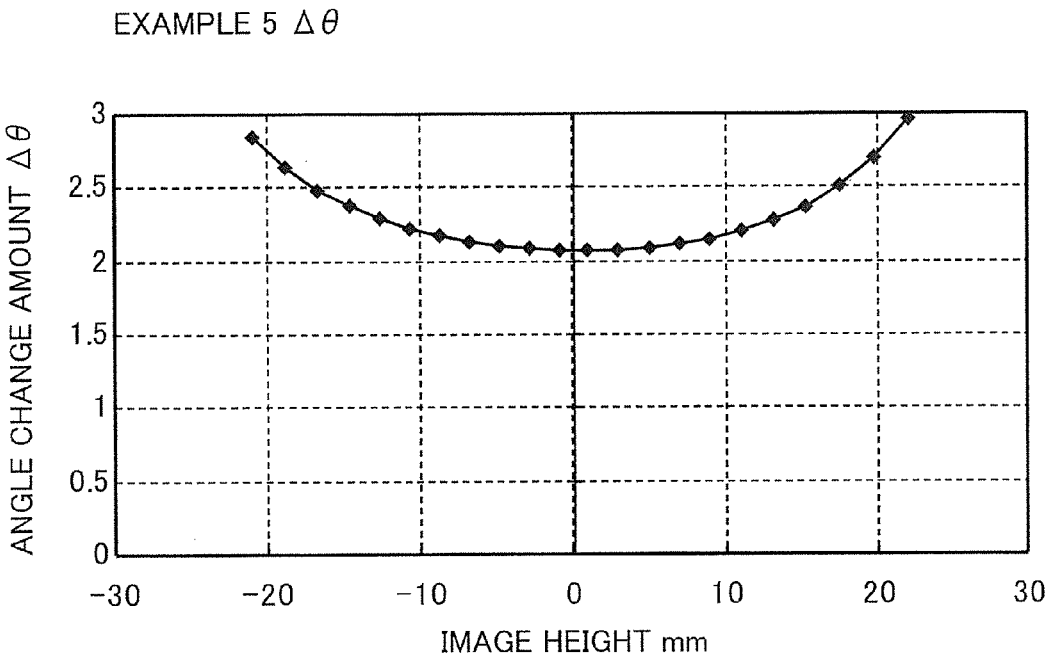
FIG. 26 is a graph showing the amount of change Δθ in the oblique angle θ of a principal ray with respect to the normal to an incident surface of a first scanning lens in a main scanning direction, the lens having been used in Example 5.
Figure 27:
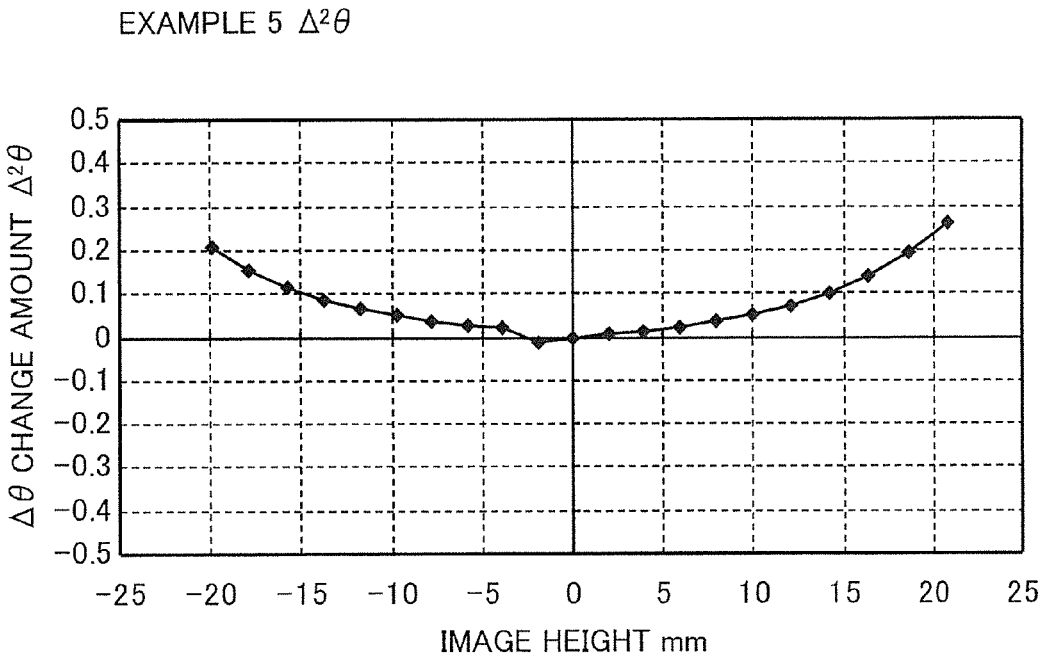
FIG. 27 is a graph showing the amount of change Δ2θ in Δθ.
Figure 28:
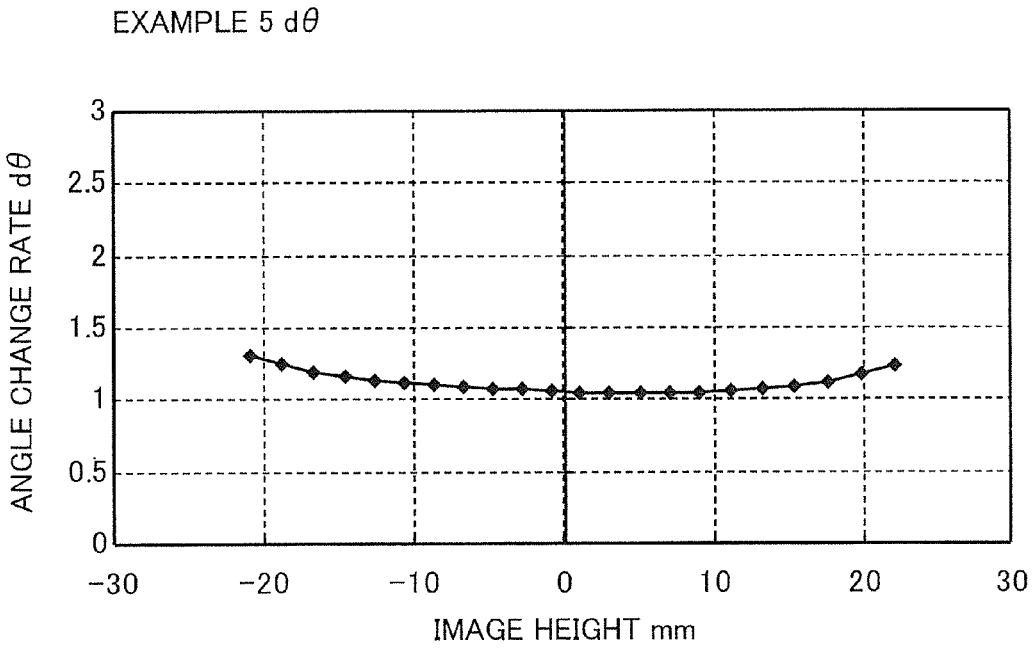
FIG. 28 is a graph showing the rate of change dθ in the oblique angle θ.

FIG. 26 is a graph showing the amount of change Δθ in the oblique angle θ of a light beam incident on an incident surface 61 of the first scanning lens 6 used in Example 5. FIG. 27 is a graph showing the amount of change Δ2θ in Δθ. As seen from FIG. 27, Δ2θ changes in the positive direction at ends of an image height, compared to the point where the image height=0 mm. In other words, Δ2θ increases from the center to the ends in a main scanning direction (the case of Δ2θ>0). FIG. 28 is a graph showing the rate of change dθ in the oblique angle θ with respect to the incident surface 61 according to Example 5 in the main scanning direction.

Figure 29:
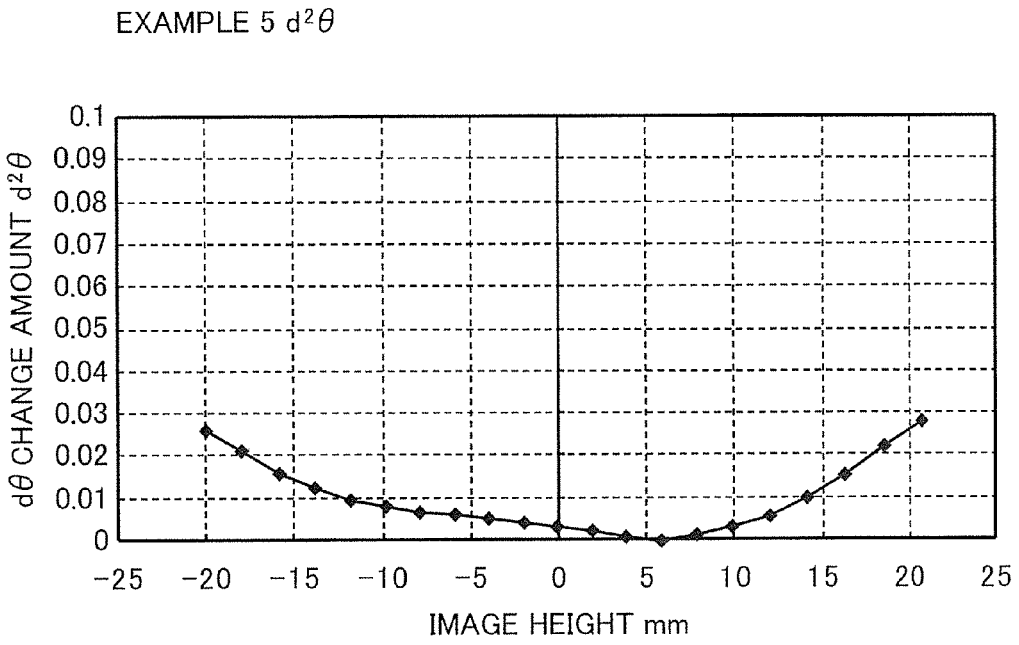
FIG. 29 is a graph showing the rate of change d2θ in dθ.
Figure 30:
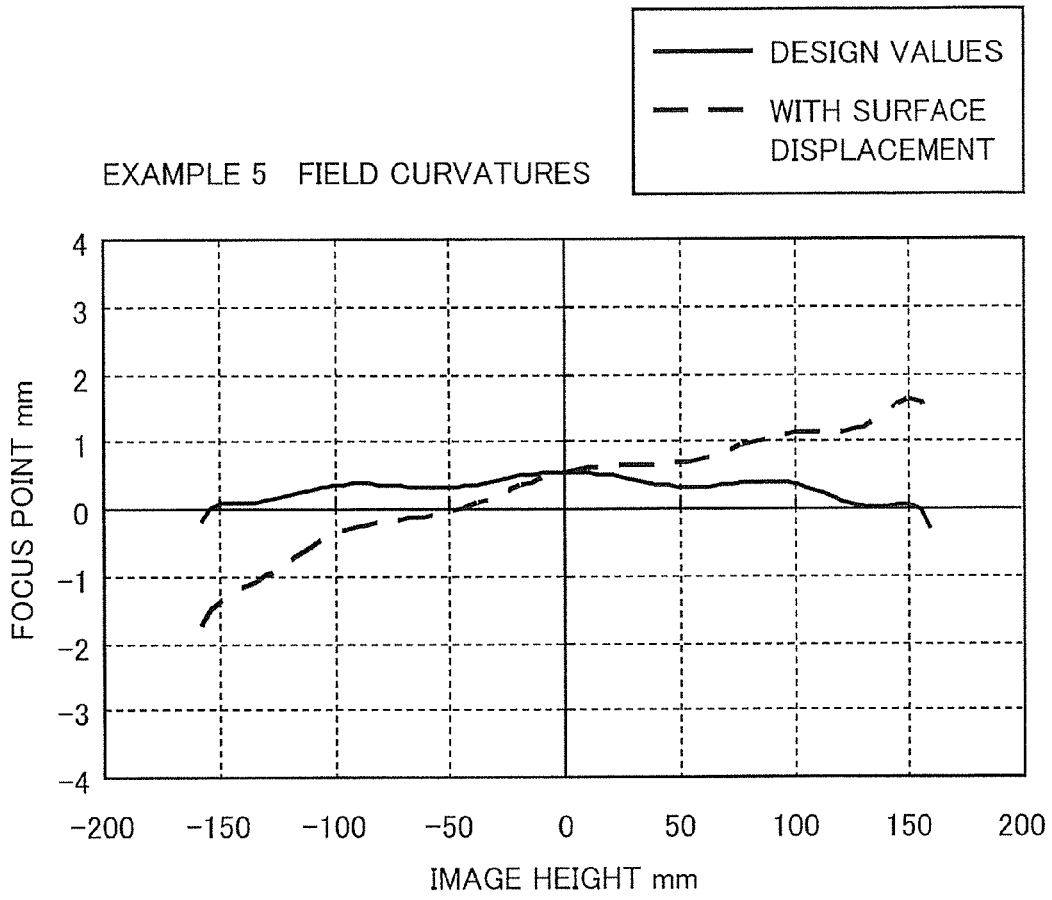
FIG. 30 is a graph showing field curvatures of an optical scanning device according to Example 5.

FIG. 29 is a graph showing the rate of change d2θ in the above-shown dθ. The maximum value of d2θ is at the point where the image height=±22 mm, which is about d2θ=0.028. Therefore, Example 5 satisfies the condition defined by the reference value: $d^2\theta<|0.036|$. FIG. 30 is a graph showing field curvatures of the imaging optical system according to Example 5 in the main scanning direction. In FIG. 30, it is not only that a field curvature in the main scanning direction is good over the entire image height in the case of "design values", but also in the case of "with a surface displacement", the maximum focus point shift amount G is about 3.2 mm. Accordingly, it is confirmed that the first scanning lens 6 of Example 5 is at a level that causes no problem in practical use.

EXAMPLE 6

Case of $\Delta^2\theta>0>$

Exemplary construction data of an imaging optical system according to Example 6 is shown in Tables 11 and 12. The optical arrangement of the imaging optical system according to Example 6 is the same as that of Example 1 (the arrangement shown in FIG. 3). Table 11 shows face-to-face distances in the imaging optical system and main scanning/sub-scanning radii of curvature of a first scanning lens 6 and second scanning lenses 7 according to Example 6. Table 12 shows the surface shapes of the first scanning lens 6 and the second scanning lenses 7 of Example 6.

| | Face-to-face distance | Main scanning radius of curvature | Sub-scanning radius of curvature | Refractive index |
|---|---|---|---|---|
| Deflector | 37.7 | | | |
| Lens I Incident surface | 9.5 | −117.753 | −800 | 1.5072 |
| Exit surface | | −65.100 | −130 | |
| | 207 | | | |
| Lens II Incident surface | 4 | −538.013 | 73.65 | 1.5072 |
| Exit surface | | 3000 | −90 | |
| | 72.5 | | | |
| Photoconductive member | | | | |

| | Lens I | | Lens II | |
|---|---|---|---|---|
| | Incident surface | Exit surface | Incident surface | Exit surface |
| Rm0 | −117.753 | −65.100 | −538.013 | 3000 |
| K | 0.351 | −1.725 | −1.075078 | 0 |
| A4 | 8.94E−07 | −1.19E−07 | 5.26E−08 | 0.00E+00 |
| A6 | −1.17E−10 | 1.31E−10 | −1.04E−12 | 0.00E+00 |
| A8 | 5.79E−13 | 1.07E−13 | 1.44E−17 | 0 |
| A10 | −5.46E−16 | −8.51E−18 | −1.04E−22 | 0 |
| Rs0 | −800 | −130 | 73.65 | −90 |
| B1 | | | 0.0008356 | 0 |
| B2 | | | 0 | 0 |
| B3 | | | 7.05E−08 | 0 |
| B4 | | | 0.00E+00 | 0.00E+00 |
| B5 | | | −3.94E−12 | 0 |
| B6 | | | 0.00E+00 | 0.00E+00 |

Figure 31:
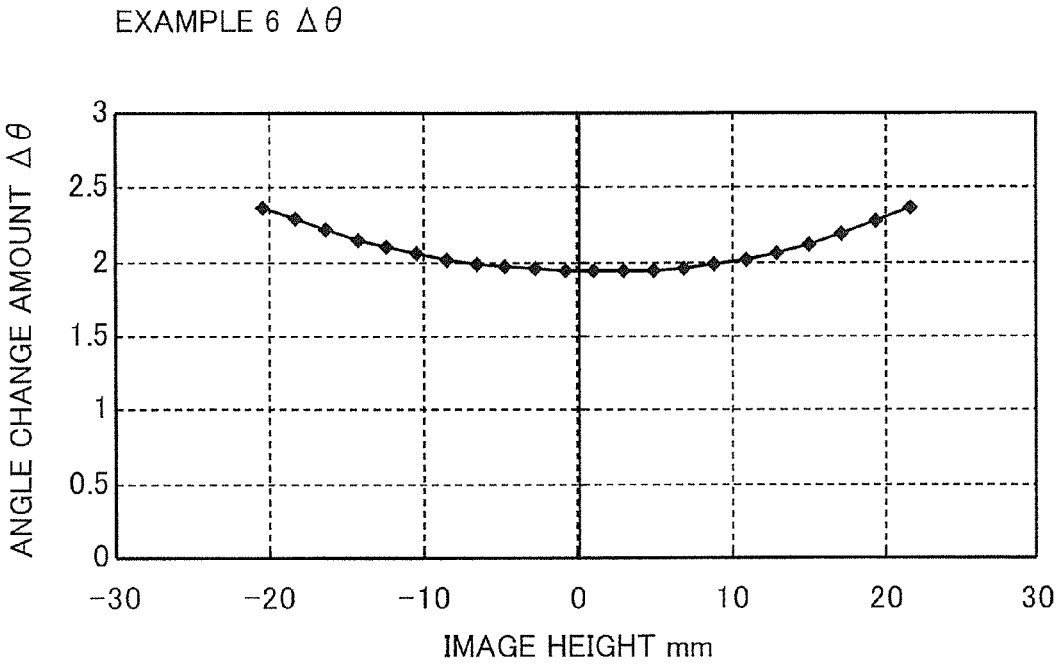
FIG. 31 is a graph showing the amount of change Δθ in the oblique angle θ of a principal ray with respect to the normal to an incident surface of a first scanning lens in a main scanning direction, the lens having been used in Example 6.
Figure 32:
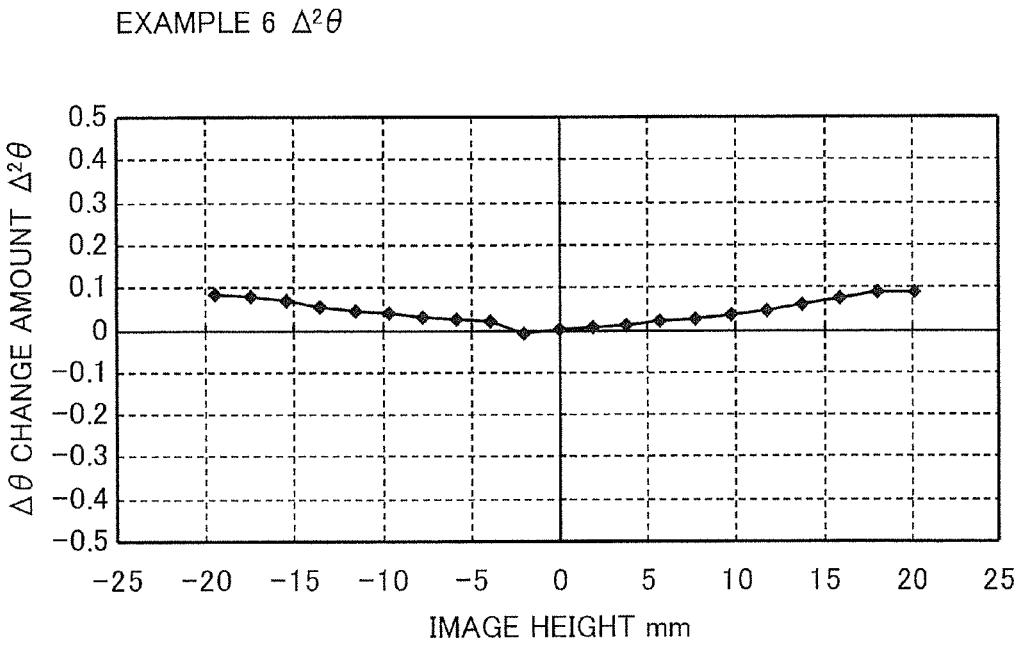
FIG. 32 is a graph showing the amount of change Δ2θ in Δθ.
Figure 33:
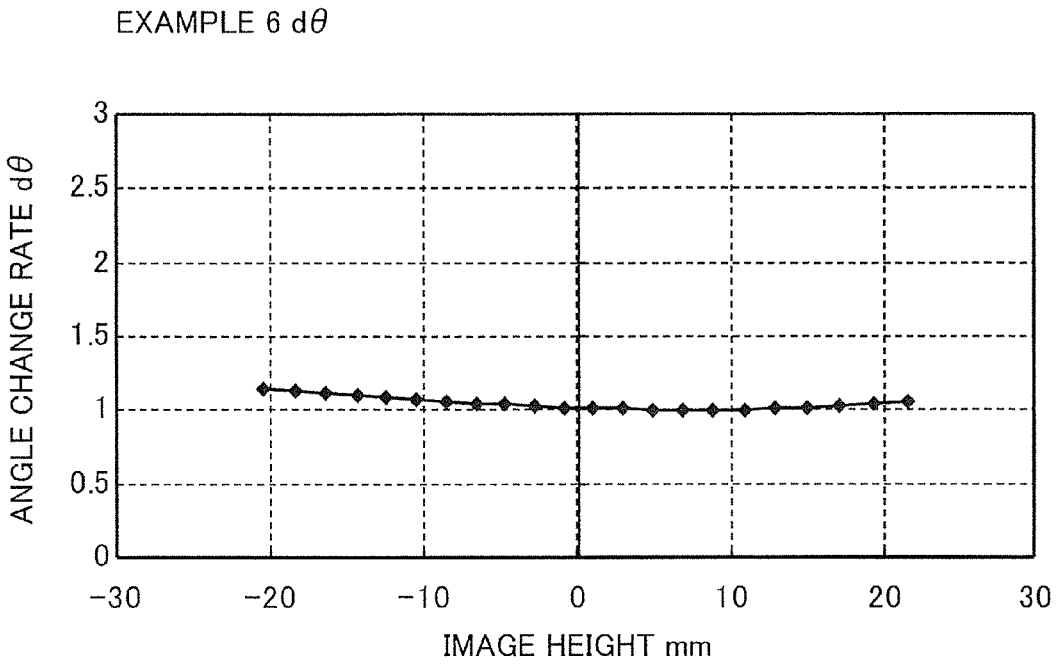
FIG. 33 is a graph showing the rate of change dθ in the oblique angle θ.

FIG. 31 is a graph showing the amount of change $\Delta\theta$ in the oblique angle $\theta$ of a light beam incident on an incident surface 61 of the first scanning lens 6 used in Example 6. FIG. 32 is a graph showing the amount of change $\Delta 2\theta$ in $\Delta\theta$. As seen from FIG. 32, $\Delta 2\theta$ changes in the positive direction at ends of an image height, compared to the point where the image height=0 mm. In other words, $\Delta 2\theta$ increases from the center to the ends in a main scanning direction (the case of $\Delta 2\theta>0$). FIG. 33 is a graph showing the rate of change $d\theta$ in the oblique angle $\theta$ with respect to the incident surface 61 according to Example 6 in the main scanning direction.

Figure 34:
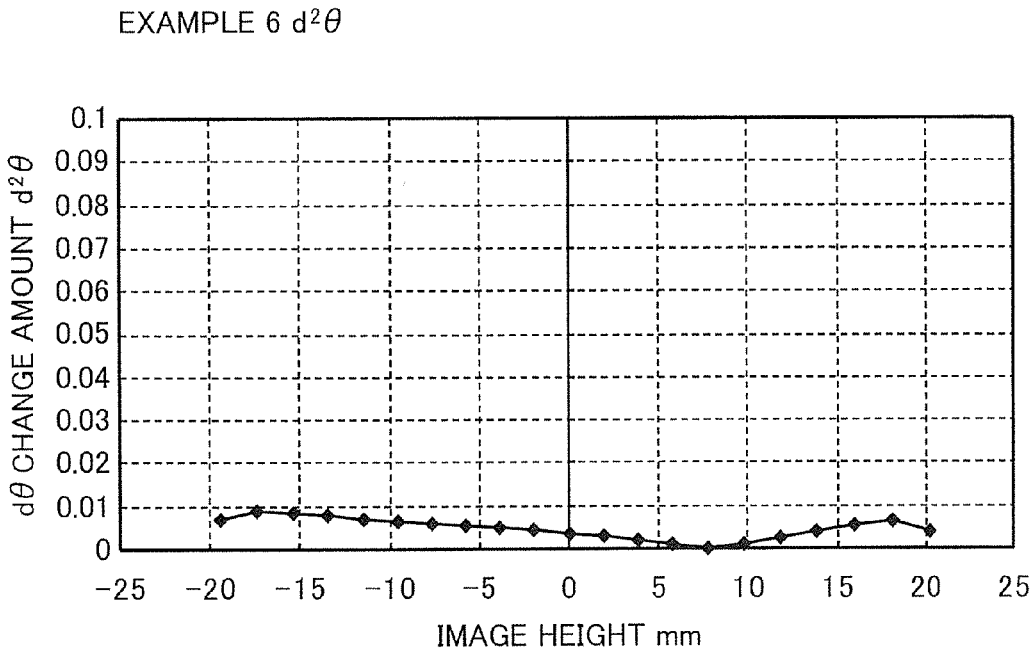
FIG. 34 is a graph showing the rate of change d2θ in dθ.
Figure 35:
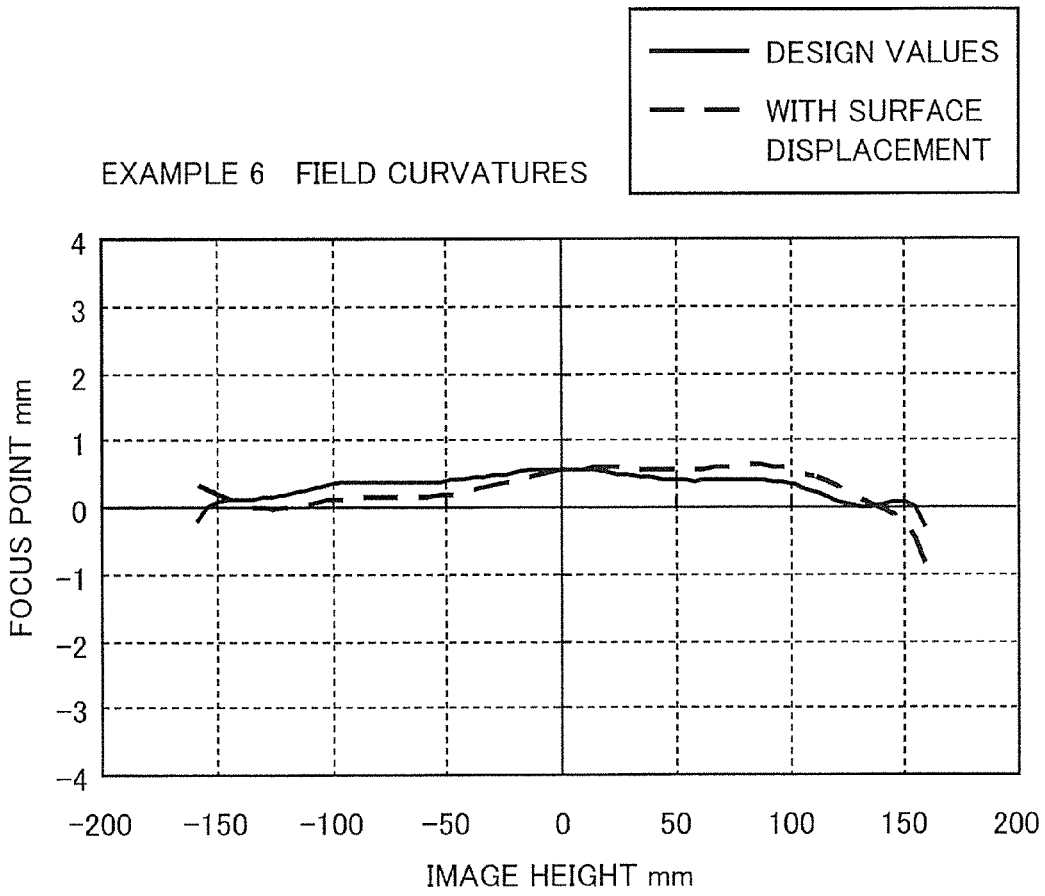
FIG. 35 is a graph showing field curvatures of an optical scanning device according to Example 6.

FIG. 34 is a graph showing the rate of change $d2\theta$ in the above-shown $d\theta$. The maximum value of $d^2\theta$ is at the point where the image height=−18 mm, which is about $d^2\theta=0.008$. Therefore, Example 6 satisfies the condition defined by the reference value: $d^2\theta<|0.036|$. FIG. 35 is a graph showing field curvatures of the imaging optical system according to Example 6 in the main scanning direction. In FIG. 35, it is not only that a field curvature in the main scanning direction is good over the entire image height in the case of "design values", but also in the case of "with a surface displacement", the maximum focus point shift amount G is about 1.4 mm. Accordingly, it is confirmed that the first scanning lens 6 of Example 6 is at a level that causes no problem in practical use.

Comparative Examples 1 to 3 are provided for comparison with the above-described Examples 1 to 6, Comparative Examples showing cases where $d^2\theta$ exceeds the above-defined reference value.

COMPARATIVE EXAMPLE 1

Case of $\Delta^2\theta<0>$

Exemplary construction data of an imaging optical system according to Comparative Example 1 is shown in Tables 13 and 14. The optical arrangement of the imaging optical system according to Comparative Example 1 is the same as that of Example 1 (the arrangement shown in FIG. 3). Table 13 shows face-to-face distances in the imaging optical system and main scanning/sub-scanning radii of curvature of a first scanning lens 6 and second scanning lenses 7 according to Comparative Example 1. Table 14 shows the surface shapes of the first scanning lens 6 and the second scanning lenses 7 of Comparative Example 1.

| | Face-to-face distance | Main scanning radius of curvature | Sub-scanning radius of curvature | Refractive index |
|---|---|---|---|---|
| Deflector | 41.8 | | | |
| Lens I Incident surface | 9.5 | −99.576 | −600 | 1.5072 |
| Exit surface | | −60.175 | −130 | |
| | 200 | | | |
| Lens II Incident surface | 4 | −488.078 | 73.65 | 1.5072 |
| Exit surface | | 3000 | −90 | |
| | 90 | | | |
| Photoconductive member | | | | |

| | Lens I | | Lens II | |
|---|---|---|---|---|
| | Incident surface | Exit surface | Incident surface | Exit surface |
| Rm0 | −99.576 | −60.175 | −488.078 | 3000 |
| K | 2.785 | −1.018 | −9.023599 | 0 |
| A4 | 3.07E−07 | −5.29E−07 | 4.34E−08 | 1.77E−08 |
| A6 | −2.04E−10 | −2.44E−10 | −8.51E−13 | 1.82E−13 |
| A8 | −8.27E−15 | −3.44E−14 | 8.50E−18 | 0 |
| A10 | −5.75E−16 | −2.97E−16 | −2.23E−23 | 0 |
| Rs0 | −600 | −130 | 73.65 | −90 |
| B1 | | | 0.0008356 | 0 |
| B2 | | | −0.00079 | 0.0009 |
| B3 | | | 7.05E−08 | 0 |
| B4 | | | 1.16E−08 | −1.33E−09 |
| B5 | | | −3.94E−12 | 0 |
| B6 | | | 7.70E−13 | 9.96E−13 |

Figure 36:
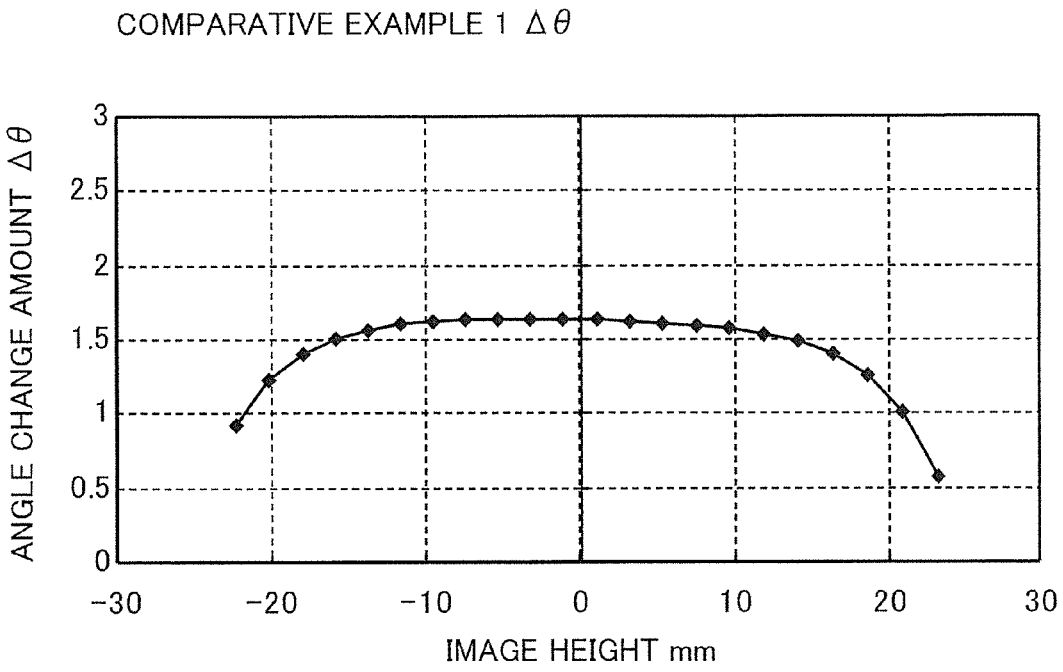
FIG. 36 is a graph showing the amount of change Δθ in the oblique angle θ of a principal ray with respect to the normal to an incident surface of a first scanning lens in a main scanning direction, the lens having been used in Comparative Example 1.
Figure 37:
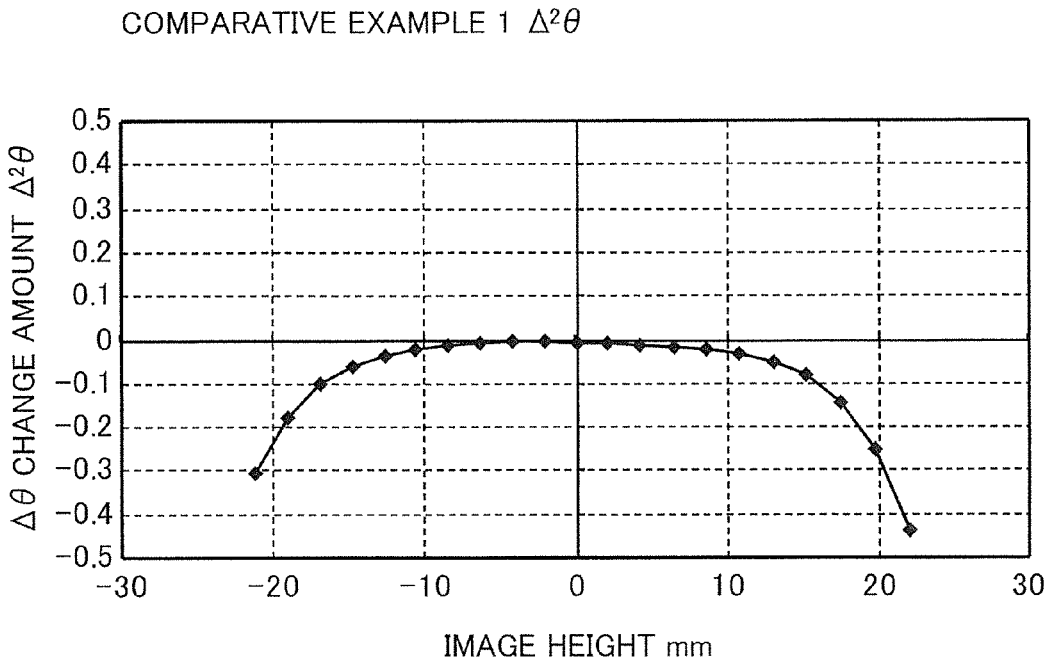
FIG. 37 is a graph showing the amount of change Δ2θ in Δθ.
Figure 38:
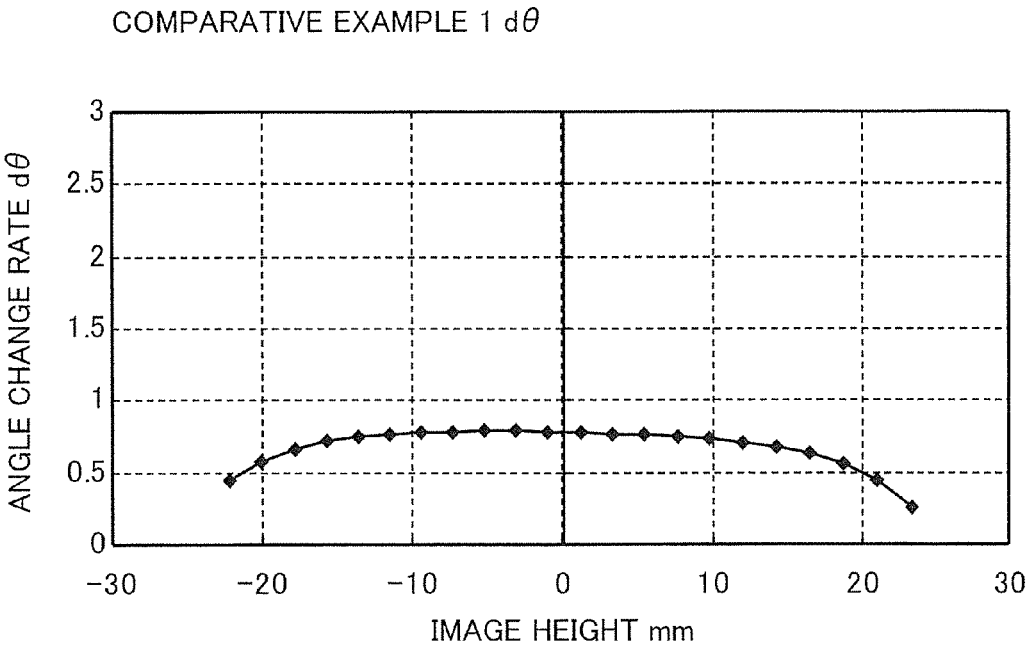
FIG. 38 is a graph showing the rate of change dθ in the oblique angle θ.

FIG. 36 is a graph showing the amount of change $\Delta\theta$ in the oblique angle $\theta$ of a light beam incident on an incident surface 61 of the first scanning lens 6 used in Comparative Example 1. FIG. 37 is a graph showing the amount of change $A^2\theta$ in $\Delta\theta$. As seen from FIG. 37, $A^2\theta$ changes in the negative direction at ends of an image height, compared to the point where the image height=0 mm. In other words, $A^2\theta$ decreases from the center to the ends in a main scanning direction (the case of $A^2\theta<0$). FIG. 38 is a graph showing the rate of change $d\theta$ in the oblique angle $\theta$ with respect to the incident surface 61 according to Comparative Example 1 in the main scanning direction.

Figure 39:
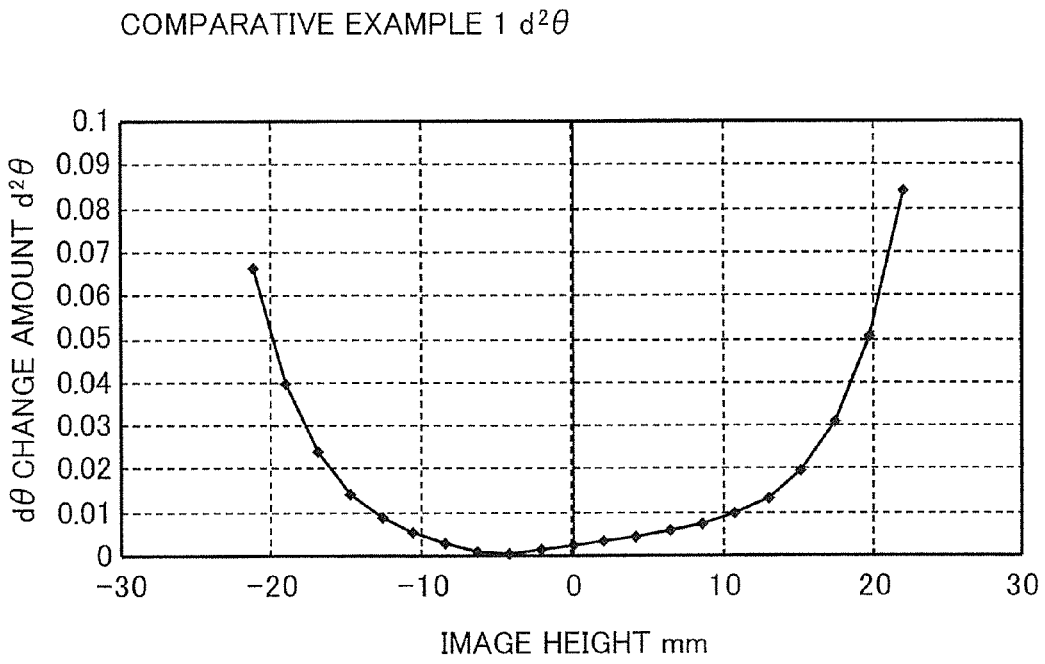
FIG. 39 is a graph showing the rate of change d2θ in dθ.
Figure 40:
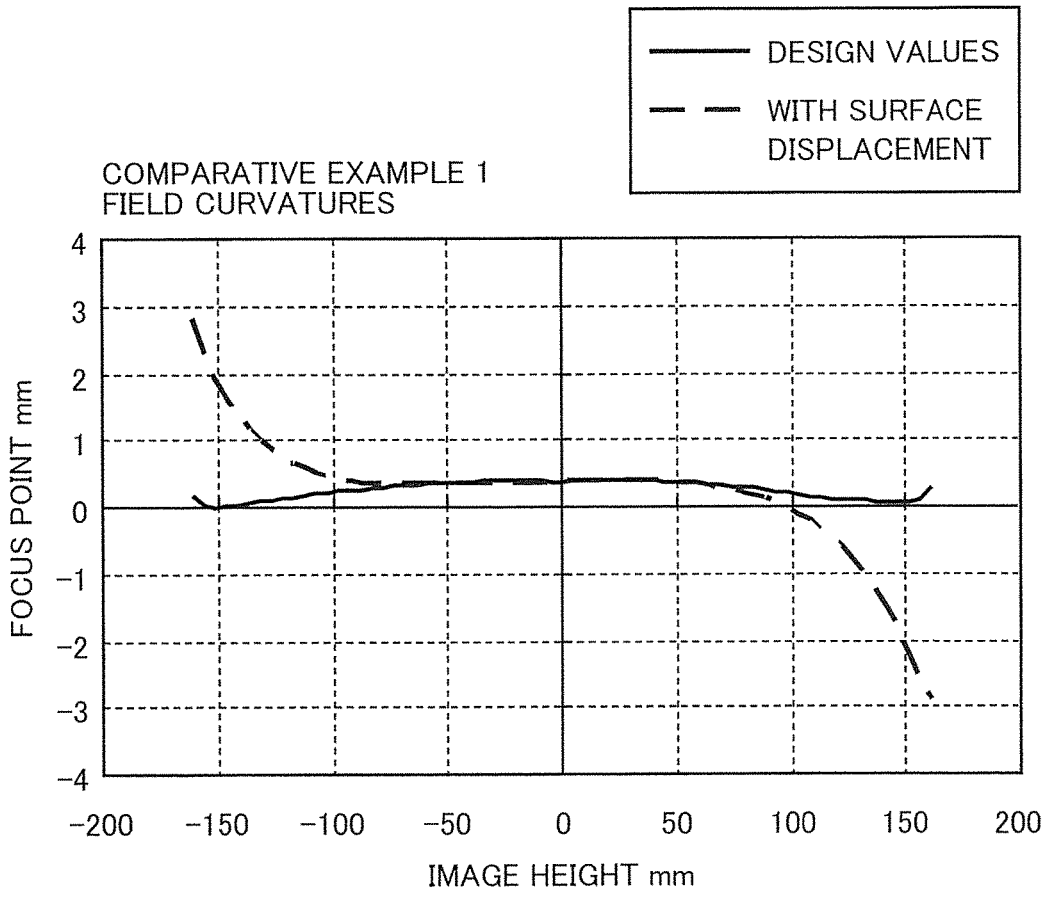
FIG. 40 is a graph showing field curvatures of an optical scanning device according to Comparative Example 1.

FIG. 39 is a graph showing the rate of change $d^2\theta$ in the above-shown $d\theta$. The maximum value of $d^2\theta$ is at the point where the image height=+22 mm, which is as much as $d^2\theta=0.085$. Therefore, Comparative Example 1 does not satisfy the condition defined by the reference value: $d^2\theta<|0.061|$. FIG. 40 is a graph showing field curvatures of the imaging optical system according to Comparative Example 1 in the main scanning direction. In FIG. 40, a field curvature in the main scanning direction is good over the entire image height in the case of "design values". On the other hand, in the case of "with a surface displacement", the maximum focus point shift amount G is as much as nearly 6 mm. Accordingly, the first scanning lens 6 of Comparative Example 1 is at a level that causes problems in practical use.

COMPARATIVE EXAMPLE 2

Case of $\Delta^2\theta<0>$

Exemplary construction data of an imaging optical system according to Comparative Example 2 is shown in Tables 15 and 16. The optical arrangement of the imaging optical system according to Comparative Example 2 is the same as that of Example 1 (the arrangement shown in FIG. 3). Table 15 shows face-to-face distances in the imaging optical system and main scanning/sub-scanning radii of curvature of a first scanning lens 6 and second scanning lenses 7 according to Comparative Example 2. Table 16 shows the surface shapes of the first scanning lens 6 and the second scanning lenses 7 of Comparative Example 2.

| | Face-to-face distance | Main scanning radius of curvature | Sub-scanning radius of curvature | Refractive index |
|---|---|---|---|---|
| Deflector | 40.6 | | | |
| Lens I Incident surface | 9.5 | −93.850 | −800 | 1.5072 |
| Exit surface | | −57.932 | −130 | |
| | 200 | | | |
| Lens II Incident surface | 4 | −488.078 | 73.65 | 1.5072 |
| Exit surface | | 3000 | −90 | |
| | 90 | | | |
| Photoconductive member | | | | |

| | Lens I | | Lens II | |
|---|---|---|---|---|
| | Incident surface | Exit surface | Incident surface | Exit surface |
| Rm0 | −93.850 | −57.932 | −488.078 | 3000 |
| K | 2.431 | −1.016 | −9.023599 | 0 |
| A4 | 3.93E−07 | −5.29E−07 | 4.34E−08 | −1.77E−08 |
| A6 | −1.21E−10 | −1.91E−10 | −8.51E−13 | −1.82E−13 |
| A8 | 3.69E−14 | −1.61E−14 | 8.50E−18 | 0 |
| A10 | −5.53E−16 | −2.65E−16 | −2.23E−23 | 0 |
| Rs0 | −800 | −130 | 73.65 | −90 |
| B1 | | | 0.0008356 | 0 |
| B2 | | | 0.00079 | −0.0009 |
| B3 | | | 7.05E−08 | 0 |
| B4 | | | −1.16E−08 | 1.33E−09 |
| B5 | | | −3.94E−12 | 0 |
| B6 | | | −7.70E−13 | −9.96E−13 |

Figure 41:
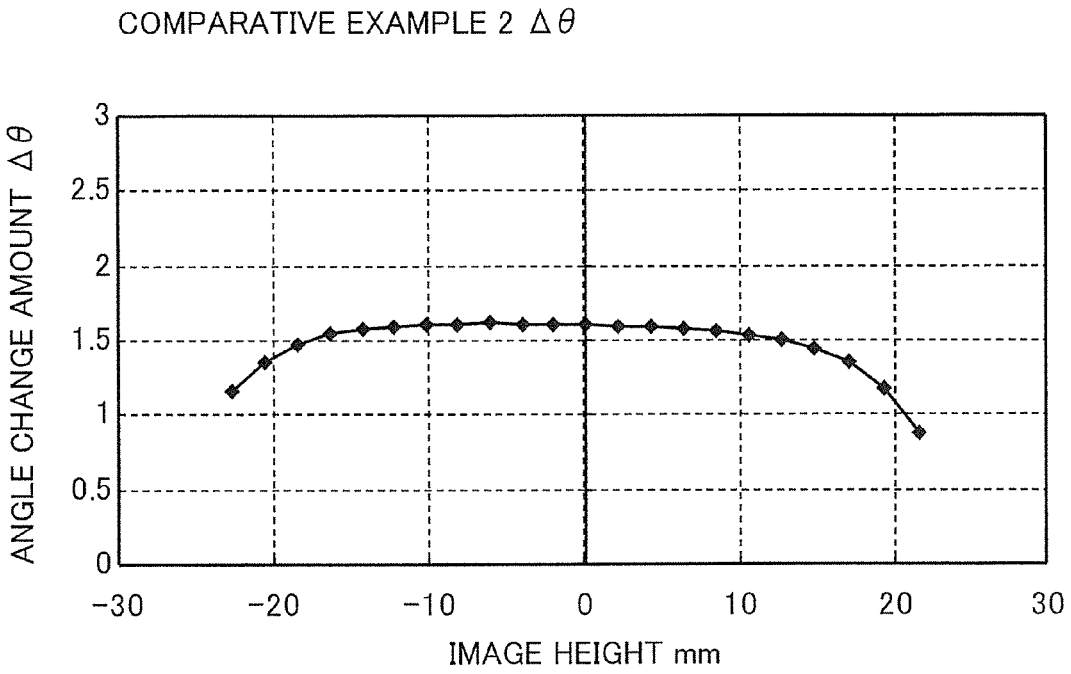
FIG. 41 is a graph showing the amount of change Δθ in the oblique angle θ of a principal ray with respect to the normal to an incident surface of a first scanning lens in a main scanning direction, the lens having been used in Comparative Example 2.
Figure 42:
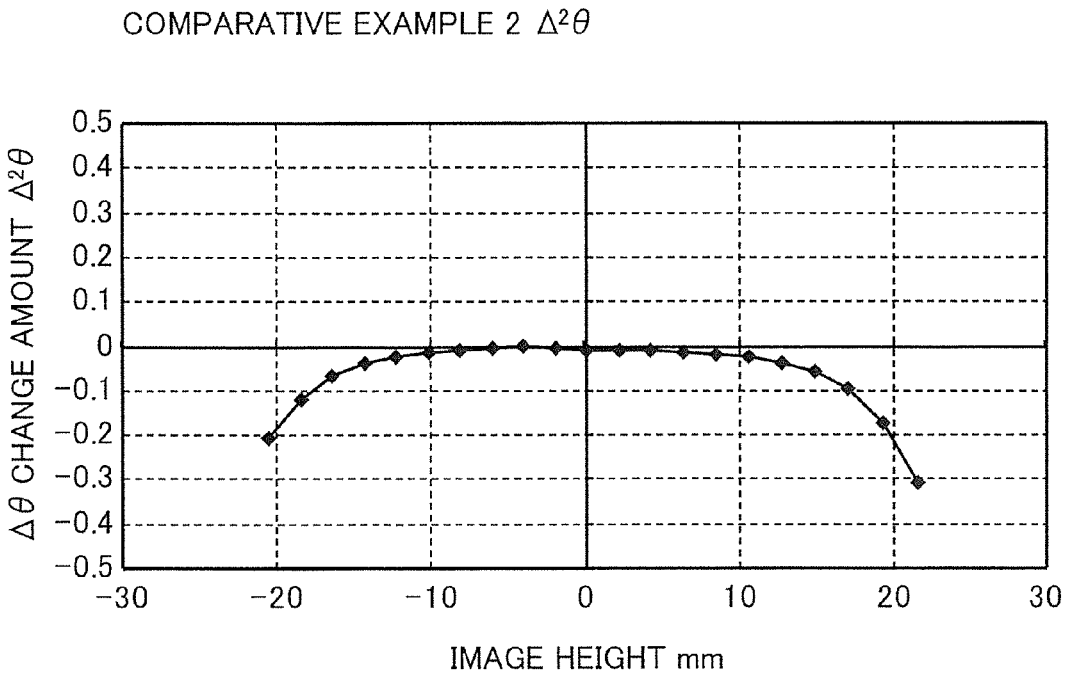
FIG. 42 is a graph showing the amount of change Δ2θ in Δθ.
Figure 43:
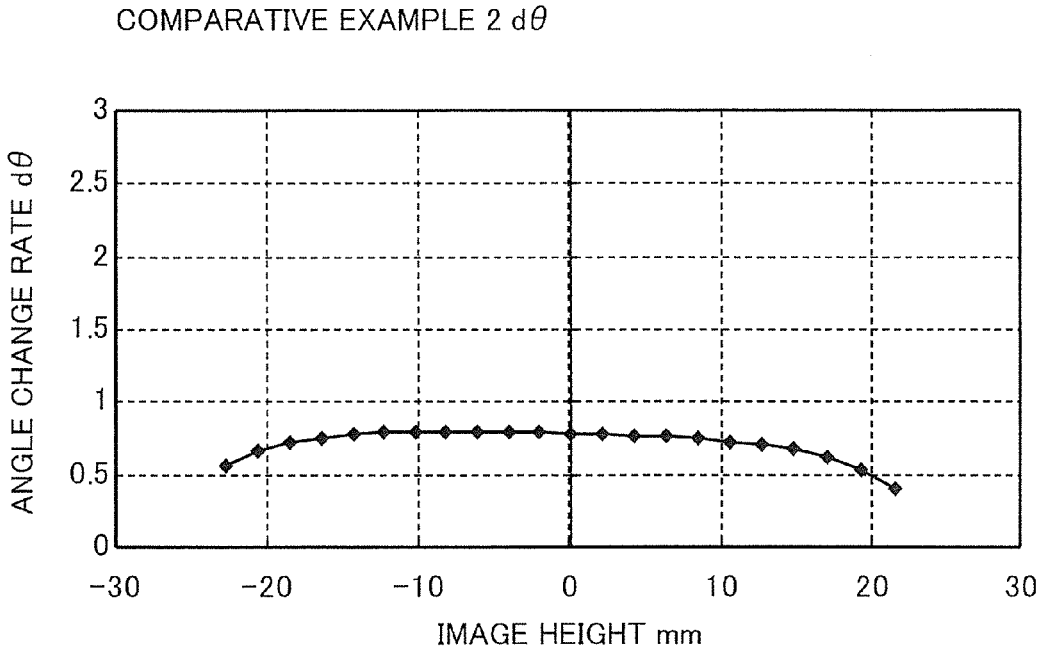
FIG. 43 is a graph showing the rate of change dθ in the oblique angle θ.

FIG. 41 is a graph showing the amount of change $\Delta\theta$ in the oblique angle $\theta$ of a light beam incident on an incident surface 61 of the first scanning lens 6 used in Comparative Example 2. FIG. 42 is a graph showing the amount of change $A^2\theta$ in $\Delta\theta$. As seen from FIG. 42, $A^2\theta$ changes in the negative direction at ends of an image height, compared to the point where the image height=0 mm. In other words, $A^2\theta$ decreases from the center to the ends in a main scanning direction (the case of $A^2<0$). FIG. 43 is a graph showing the rate of change $d\theta$ in the oblique angle $\theta$ with respect to the incident surface 61 according to Comparative Example 2 in the main scanning direction.

Figure 44:
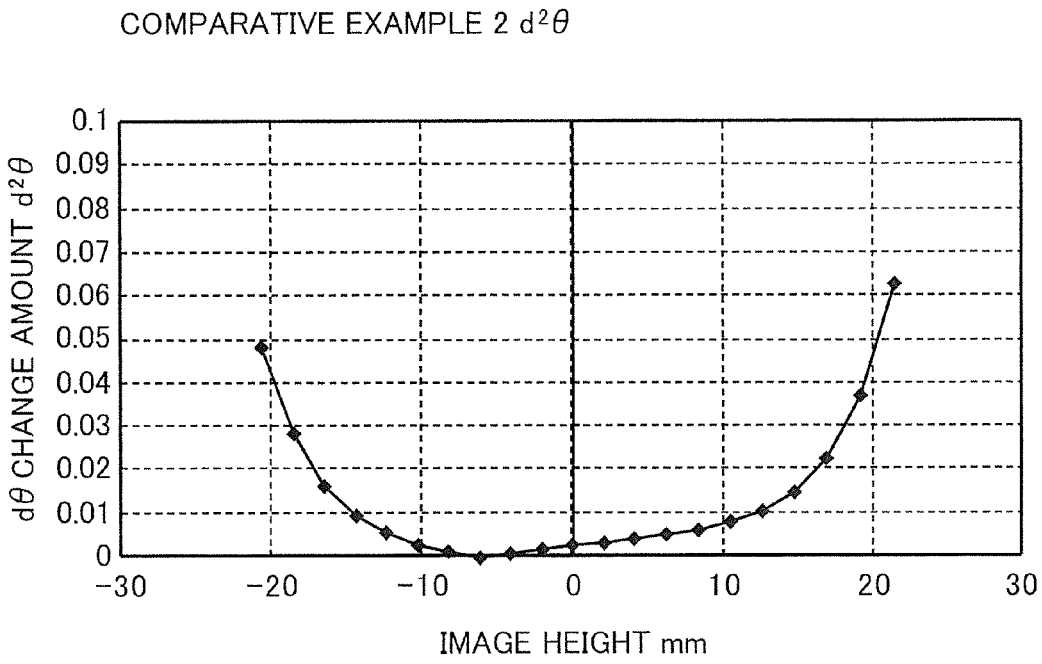
FIG. 44 is a graph showing the rate of change d2θ in dθ.
Figure 45:
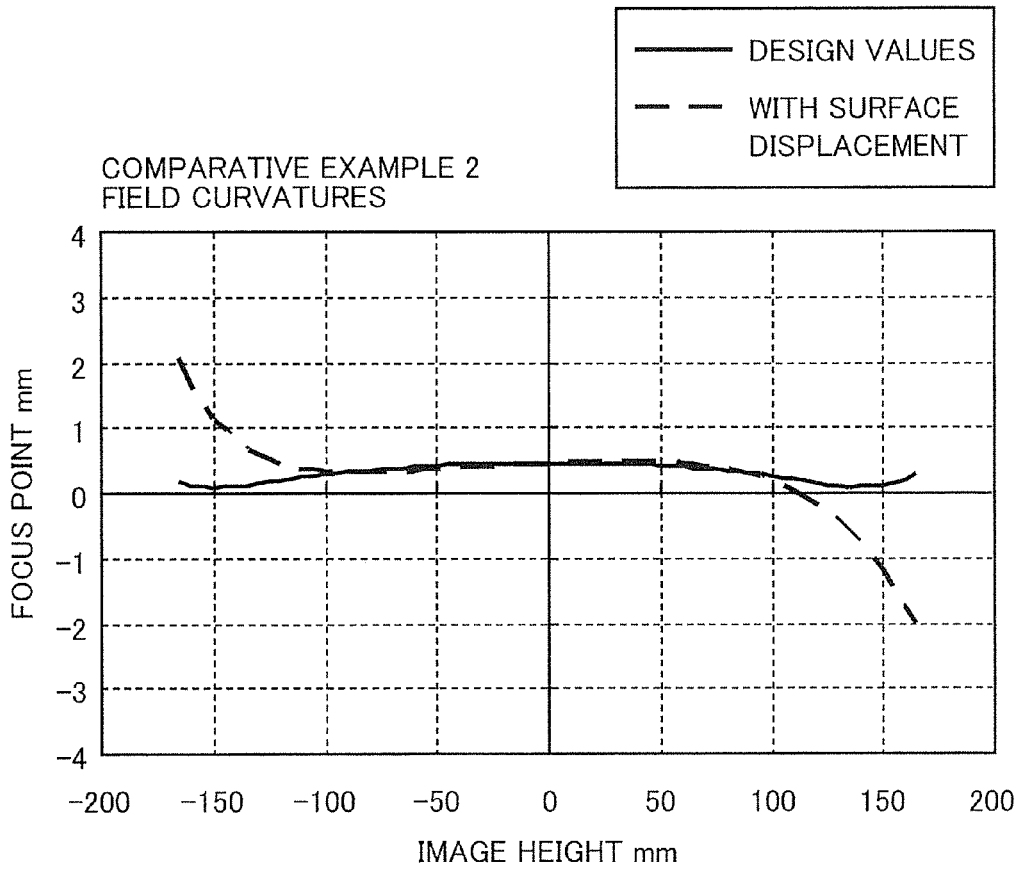
FIG. 45 is a graph showing field curvatures of an optical scanning device according to Comparative Example 2.

FIG. 44 is a graph showing the rate of change $d^2\theta$ in the above-shown $d\theta$. The maximum value of $d^2\theta$ is at the point where the image height=+22 mm, which is $d^2\theta=0.062$. Therefore, Comparative Example 2 does not satisfy the condition defined by the reference value: $d^2\theta<|0.061|$. FIG. 45 is a graph showing field curvatures of the imaging optical system according to Comparative Example 2 in the main scanning direction. In FIG. 45, a field curvature in the main scanning direction is good over the entire image height in the case of "design values". On the other hand, in the case of "with a surface displacement", the maximum focus point shift amount G exceeds 4 mm. Accordingly, the first scanning lens 6 of Comparative Example 2 is at a level that causes problems in practical use.

COMPARATIVE EXAMPLE 3

Case of $\Delta^2\theta>0>$

Exemplary construction data of an imaging optical system according to Comparative Example 3 is shown in Tables 17 and 18. The optical arrangement of the imaging optical system according to Comparative Example 3 is the same as that of Example 1 (the arrangement shown in FIG. 3). Table 17 shows face-to-face distances in the imaging optical system and main scanning/sub-scanning radii of curvature of a first scanning lens 6 and second scanning lenses 7 according to Comparative Example 3. Table 18 shows the surface shapes of the first scanning lens 6 and the second scanning lenses 7 of Comparative Example 3.

| | Face-to-face distance | Main scanning radius of curvature | Sub-scanning radius of curvature | Refractive index |
|---|---|---|---|---|
| Deflector | 39 | | | |
| Lens I Incident surface | 9.5 | −164.855 | −800 | 1.5072 |
| Exit surface | | −75.904 | −130 | |
| | 200 | | | |
| Lens II Incident surface | 4 | −488.078 | 73.65 | 1.5072 |
| Exit surface | | 3000 | −90 | |
| | 90 | | | |
| Photoconductive member | | | | |

| | Lens I | | Lens II | |
|---|---|---|---|---|
| | Incident surface | Exit surface | Incident surface | Exit surface |
| Rm0 | −164.855 | −75.904 | −488.078 | 3000 |
| K | −3.310 | −2.584 | −9.023599 | 0 |
| A4 | 1.07E−06 | 9.46E−08 | 4.34E−08 | 0.00E+00 |
| A6 | −1.92E−10 | 2.63E−10 | −8.51E−13 | 0.00E+00 |
| A8 | 1.12E−12 | 2.45E−13 | 8.50E−18 | 0 |
| A10 | −5.99E−16 | 1.43E−16 | −2.23E−23 | 0 |
| Rs0 | −800 | −130 | 73.65 | −90 |
| B1 | | | 0.0008356 | 0 |
| B2 | | | 0 | 0 |
| B3 | | | 7.05E−08 | 0 |
| B4 | | | 0.00E+00 | 0.00E+00 |
| B5 | | | −3.94E−12 | 0 |
| B6 | | | 0.00E+00 | 0.00E+00 |

Figure 46:
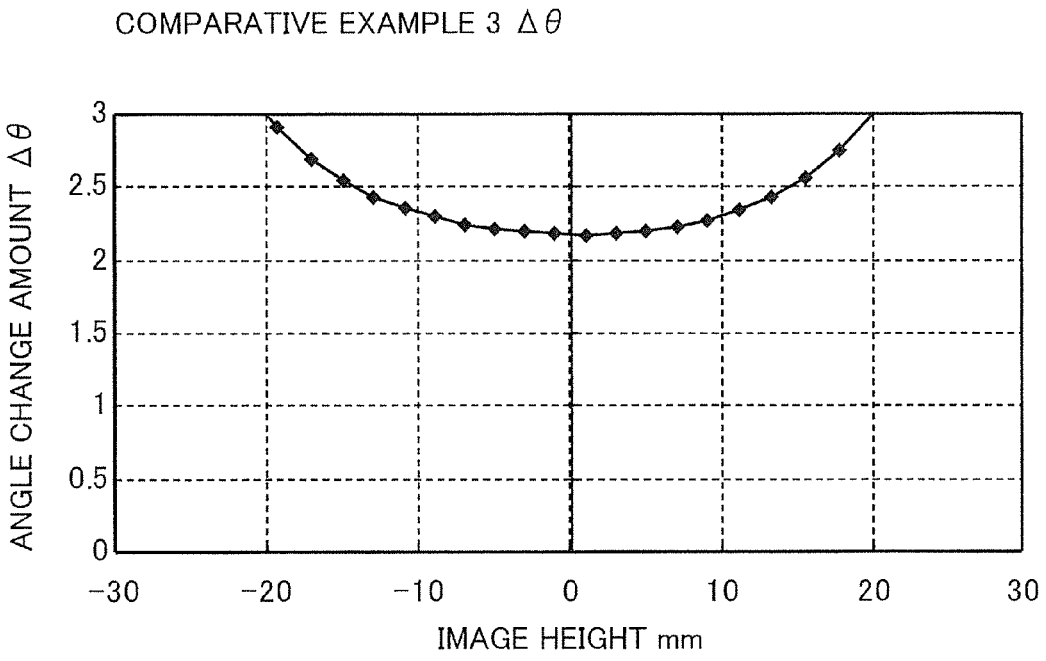
FIG. 46 is a graph showing the amount of change Δθ in the oblique angle θ of a principal ray with respect to the normal to an incident surface of a first scanning lens in a main scanning direction, the lens having been used in Comparative Example 3.
Figure 47:
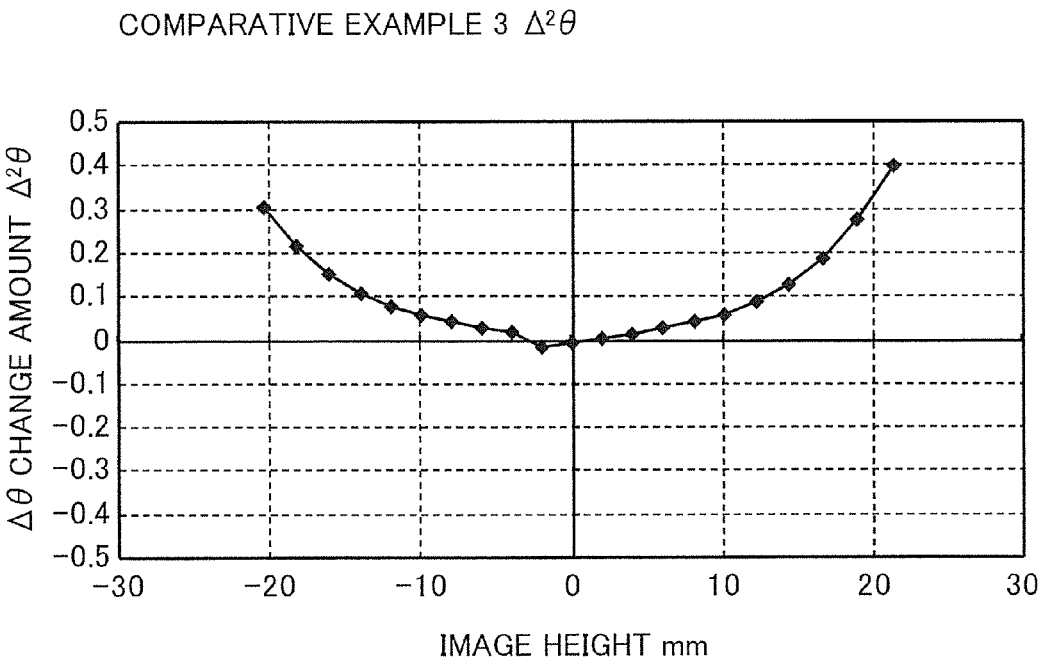
FIG. 47 is a graph showing the amount of change Δ2θ in Δθ.
Figure 48:
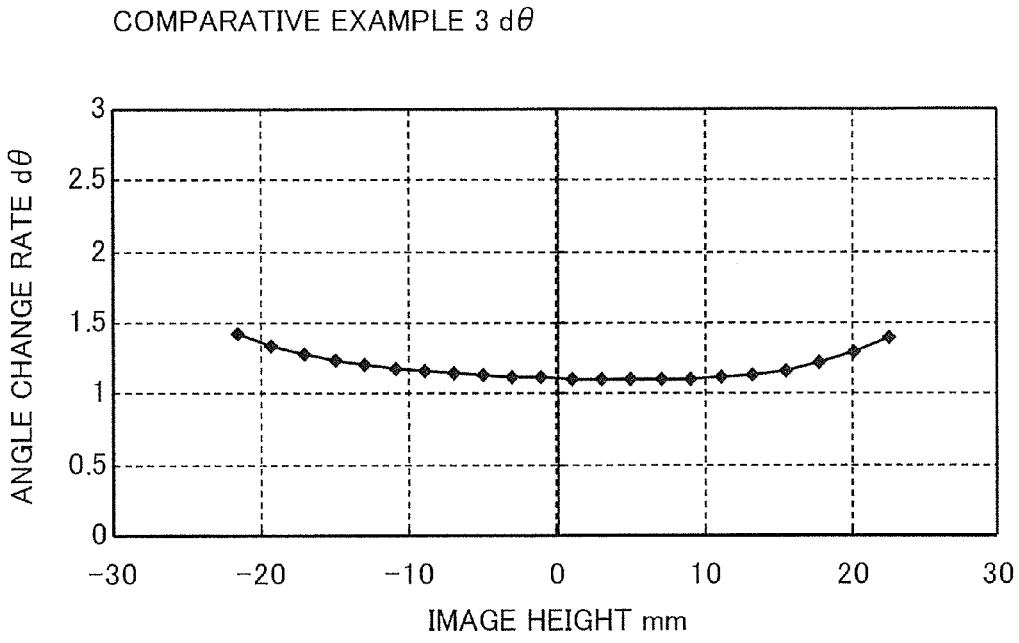
FIG. 48 is a graph showing the rate of change dθ in the oblique angle θ.

FIG. 46 is a graph showing the amount of change $\Delta\theta$ in the oblique angle $\theta$ of a light beam incident on an incident surface 61 of the first scanning lens 6 used in Comparative Example 3. FIG. 47 is a graph showing the amount of change $\Delta 2\theta$ in $\Delta\theta$. As seen from FIG. 47, $\Delta 2\theta$ changes in the positive direction at ends of an image height, compared to the point where the image height=0 mm. In other words, $\Delta 2\theta$ increases from the center to the ends in a main scanning direction (the case of $\Delta 2\theta>0$). FIG. 48 is a graph showing the rate of change $d\theta$ in the oblique angle $\theta$ with respect to the incident surface 61 according to Comparative Example 3 in the main scanning direction.

Figure 49:
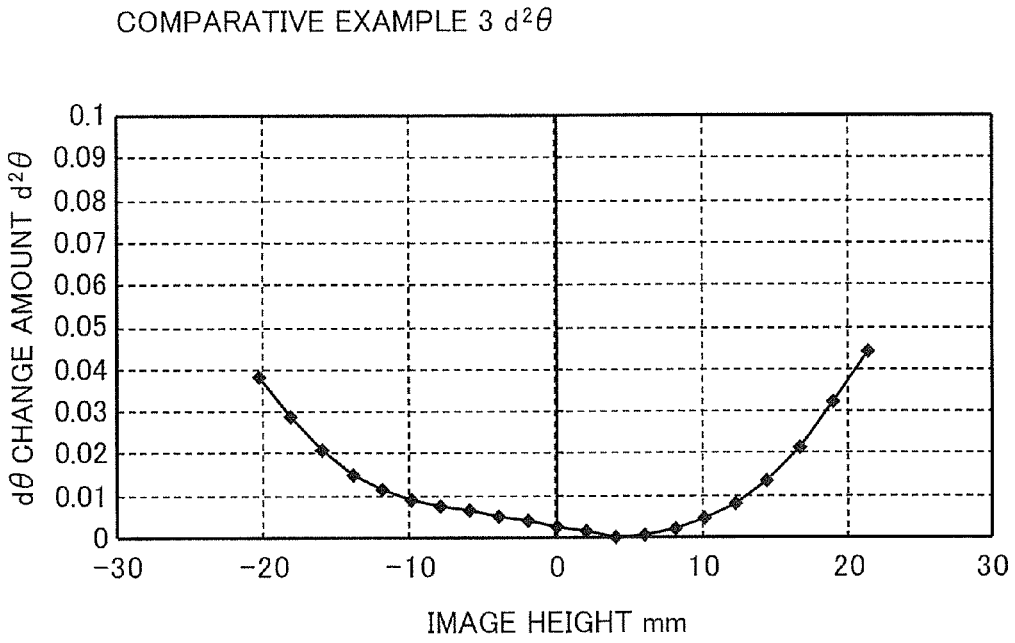
FIG. 49 is a graph showing the rate of change d2θ in dθ.

FIG. 49 is a graph showing the rate of change $d2\theta$ in the above-shown $d\theta$. The maximum value of $d2\theta$ is at the point where the image height=+22 mm, which is $d2\theta=0.045$.

Figure 50:
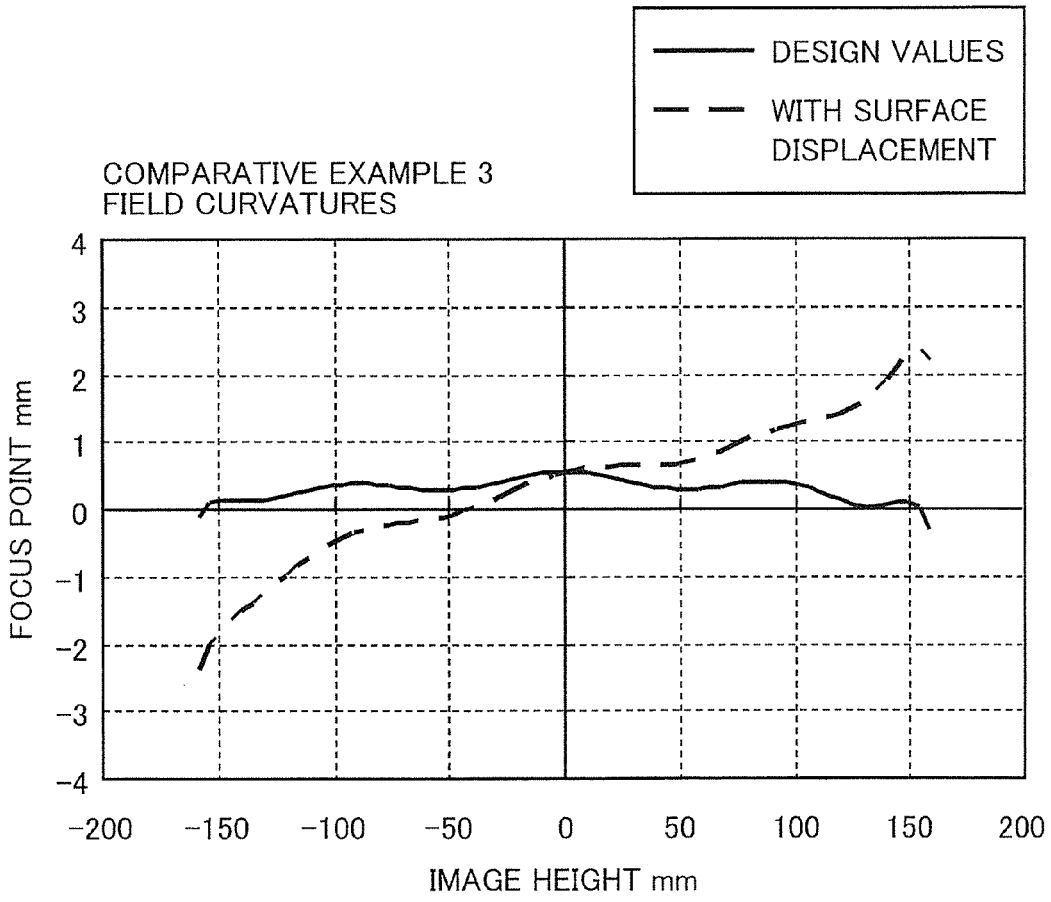
FIG. 50 is a graph showing field curvatures of an optical scanning device according to Comparative Example 3.

Therefore, Comparative Example 3 does not satisfy the condition defined by the reference value: $d^2\theta<|0.036|$. FIG. 50 is a graph showing field curvatures of the imaging optical system according to Comparative Example 3 in the main scanning direction. In FIG. 50, a field curvature in the main scanning direction is good over the entire image height in the case of "design values". On the other hand, in the case of "with a surface displacement", the maximum focus point shift amount G is as much as nearly 5 mm. Accordingly, the first scanning lens 6 of Comparative Example 3 is at a level that causes problems in practical use.

Figure 51:
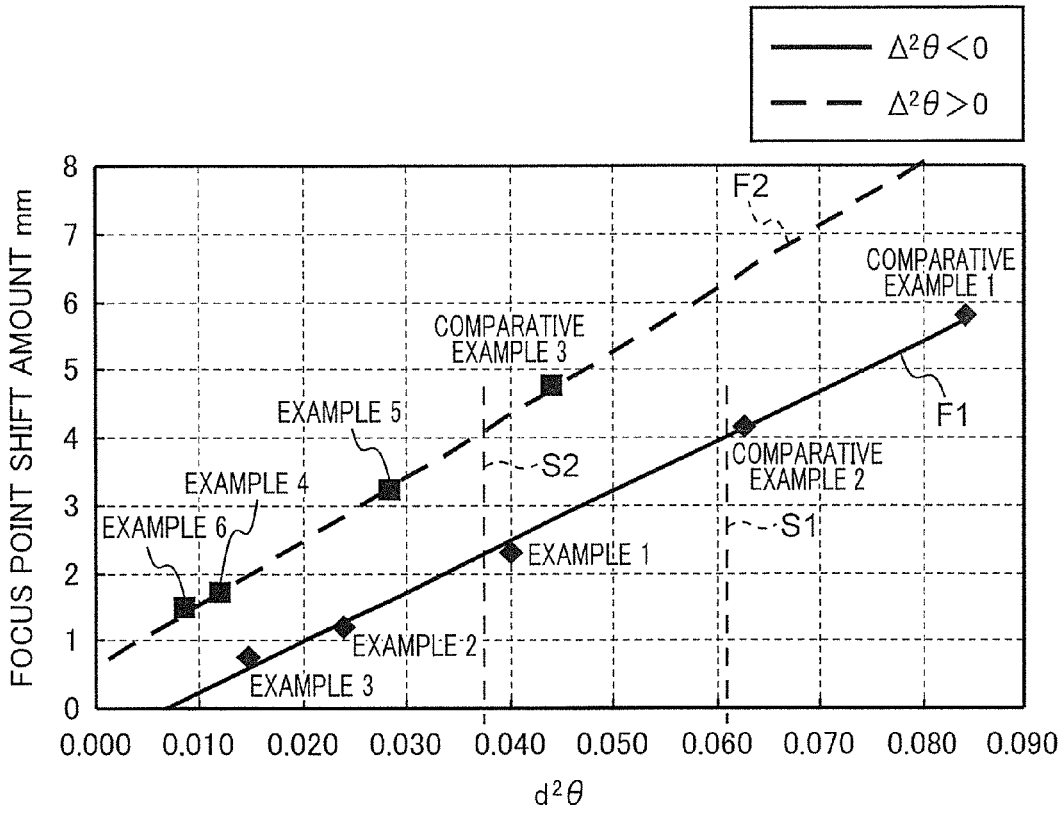
FIG. 51 is a graph showing maximum value plots of focus point shift amounts in relation to Δ2θ in the cases of a surface displacement, the values obtained in Examples 1 to 6 and Comparative Examples 1 to 3.

FIG. 51 is a graph showing maximum value plots of focus point shift amounts in relation to $\Delta 2\theta$ in the cases of a surface displacement, the values obtained in Examples 1 to 6 and Comparative Examples 1 to 3. In FIG. 51, the solid line F1 is a straight line connecting Examples 1, 2, 3 and Comparative Examples 1 and 2 belonging to the category of $\Delta 2\theta<0$ in which $\Delta 2\theta$ decreases from the center to the ends in the main scanning direction. On the other hand, the dotted line F2 is a straight line connecting Examples 4, 5, 6 and Comparative Example 3 belonging to the category of $\Delta 2\theta>0$ in which $\Delta 2\theta$ increases from the center to the ends in the main scanning direction.

The perpendicular line S1 in FIG. 51 is a straight line extending perpendicularly downward from the intersecting point of the solid line F1 and the vertical level of "4 mm" that is a permissible value of the maximum focus point shift amount G Based on the point where the perpendicular line S1 crosses the horizontal axis, the above-defined permissible upper limit value of $d2\theta=|0.061|$ in the category of $\Delta^2\theta<0$ has been derived. Further, the perpendicular line S2 is a straight line extending perpendicularly downward from the point of the dotted line F2 and the above-mentioned vertical level of "4 mm". Based on the point where the perpendicular line S2 crosses the horizontal axis, the above-identified permissible upper limit value of $d^2\theta=|0.036|$ in the category of $\Delta^2\theta>0$ has been derived.

According to the above-described optical scanning device 23 of the present embodiment, when a plurality of scanning lenses are used and at least a scanning lens lying closest to a deflector serves as a common scanning lens shared by a plurality of laser beams, it is possible to reduce, even if a surface displacement occurs between an incident surface and an exit surface due to an error in the molding of the common scanning lens, the influence of the surface displacement. This therefore makes it possible to reduce the manufacturing difficulty of common scanning lenses.

The above-described embodiment illustrates the case where the first scanning lens 6 lying closest to the deflector 5 serves as a common scanning lens through which all of the laser beams LY, LC, LM, and LBk pass. The scanning lens lying closest to the deflector 5 may be in the form, not of a common scanning lens, but of a scanning lens through which only one laser beam passes.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An optical scanning device, comprising:

a light source configured to emit a light beam;

a deflector configured to deflect the light beam emitted from the light source to scan the light beam across a predetermined surface to be scanned; and a plurality of scanning lenses disposed between the deflector and the surface to be scanned, the scanning lenses being configured to image the light beam onto the surface to be scanned, wherein among the plurality of scanning lenses, at least a lens lying closest to the deflector includes an incident surface where the light beam enters and an exit surface where the light beam goes out, and has a positive refractive power in a main scanning direction, and the incident surface allows the oblique angle $\theta$ of a principal ray, which is a ray passing the center of the light beam entering the incident surface with respect to the normal to the incident surface to vary from a center to an end of the incident surface in the main scanning direction, the incident surface satisfying the following conditions, where $\Delta\theta$ is the amount of change and $d\theta$ is the rate of change in the oblique angle $\theta$ of the principal ray in the main scanning direction as defined by $d\theta=|\Delta\theta/L|$ where L is measured in millimeters, $d^2\theta$ is the rate of change in $d\theta$, and $\Delta^2\theta$ is the amount of change in $\Delta\theta$:

$d^2\theta<|0.036|$ when $\Delta^2\theta$ increases from the center to the end in the main scanning direction; and $d^2\theta<|0.061|$ when $\Delta^2\theta$ decreases from the center to the end in the main scanning direction.

2. An optical scanning device according to claim 1, further comprising another light source, wherein the deflector is in the form of a single deflecting member and deflects each of light beams respectively emitted from the plurality of light sources to scan the light beams across predetermined surfaces to be scanned respectively set for the light beams, and the lens lying closest to the deflector serves as a common scanning lens through which all of the light beams emitted from the plurality of light sources pass.

3. An optical scanning device according to claim 2, wherein the common scanning lens has a positive refractive power also in a sub scanning direction.

4. An image forming apparatus, comprising:

a plurality of image carriers each configured to carry an electrostatic latent image; and an optical scanning device according to claim 1 configured to emit light beams to circumferential surfaces of the plurality of image carriers, each of the circumferential surfaces serving as the surface to be scanned.

5. An image forming apparatus according to claim 4, further comprising another light source so that the number of light sources corresponds to that of the image carriers, wherein the deflector is in the form of a single deflecting member and deflects each of light beams respectively emitted from the plurality of light sources to scan the light beams respectively over the plurality of image carriers, the plurality of scanning lenses consist of a first scanning lens through which all of the light beams being respectively directed toward the plurality of image carries pass through, and second scanning lenses through each of which one of the light beams being directed toward one of the plurality of image carries individually passes, and the lens lying closest to the deflector serves as the first scanning lens.

6. An image forming apparatus according to claim 5, wherein the first scanning lens has a positive refractive power also in a sub scanning direction.

* * * * *